US007982120B2

(12) United States Patent
Sasaki et al.

(10) Patent No.: US 7,982,120 B2
(45) Date of Patent: Jul. 19, 2011

(54) PERFORMANCE APPARATUS AND STORAGE MEDIUM THEREFOR

(75) Inventors: Michihiko Sasaki, Hamamatsu (JP); Gou Usui, Hamamatsu (JP); Shinichi Ito, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/794,032

(22) Filed: Jun. 4, 2010

(65) Prior Publication Data

US 2010/0236386 A1 Sep. 23, 2010

Related U.S. Application Data

(62) Division of application No. 12/057,317, filed on Mar. 27, 2008.

(30) Foreign Application Priority Data

Mar. 28, 2007 (JP) ..... 2007-085509
Mar. 28, 2007 (JP) ..... 2007-085510

(51) Int. Cl.
*G10H 1/00* (2006.01)

(52) U.S. Cl. ..... 84/609; 84/649; 84/600

(58) Field of Classification Search ..... 84/600–609, 84/649

See application file for complete search history.

(56) References Cited

U.S. PATENT DOCUMENTS 4,337,529 A 6/1982 Morokawa
4,594,930 A 6/1986 Murakami
4,788,983 A 12/1988 Brink et al.
5,215,468 A 6/1993 Lauffer et al.
5,256,832 A 10/1993 Miyake
5,267,942 A 12/1993 Saperston
5,592,143 A 1/1997 Romney et al.
5,747,716 A 5/1998 Matsumoto
5,793,739 A 8/1998 Tanaka et al.
5,919,047 A 7/1999 Sone
6,013,007 A 1/2000 Root et al.
6,230,047 B1 5/2001 McHugh
6,246,362 B1 6/2001 Tsubata et al.
6,344,607 B2 * 2/2002 Cliff ..... 84/611
6,518,492 B2 2/2003 Herberger et al.

(Continued)

FOREIGN PATENT DOCUMENTS

JP 9-198068 A 7/1997

(Continued)

OTHER PUBLICATIONS

Office Action, mailed on Jan. 27, 2009, issued in corresponding JP 2007-085509.

(Continued)

*Primary Examiner* — David S. Warren
(74) *Attorney, Agent, or Firm* — Rossi, Kimms & McDowell LLP

(57) ABSTRACT

A performance apparatus capable of reproducing music pieces while making changeover between the music pieces without disturbing the rhythm of exercise, dance, or the like performed by a user to the rhythm of music. A beat position is acquired that will appear in a preceding performance data for the first time after a preparatory time required for changing the reproduction of the preceding music piece to the reproduction of a subsequent music piece elapses from when a music selection instruction is given. The reproduction of the subsequent music piece is started at the same time when the music is reproduced up to the acquired beat position.

9 Claims, 13 Drawing Sheets

U.S. PATENT DOCUMENTS

| | | | | |
|---|---|---|---|---|
| 6,572,511 | B1 | 6/2003 | Volpe | |
| 6,607,493 | B2 | 8/2003 | Song | |
| 6,623,427 | B2 | 9/2003 | Mandigo | |
| 6,787,689 | B1 | 9/2004 | Chen | |
| 6,808,473 | B2 | 10/2004 | Hisano et al. | |
| 6,822,153 | B2 * | 11/2004 | Comair et al. | 84/609 |
| 6,933,432 | B2 * | 8/2005 | Shteyn et al. | 84/609 |
| 7,003,122 | B2 | 2/2006 | Chen | |
| 7,026,536 | B2 | 4/2006 | Lu et al. | |
| 7,041,892 | B2 | 5/2006 | Becker | |
| 7,177,672 | B2 | 2/2007 | Nissila | |
| 7,183,479 | B2 | 2/2007 | Lu et al. | |
| 7,207,935 | B1 | 4/2007 | Lipo | |
| 7,534,951 | B2 | 5/2009 | Yamashita | |
| 7,615,702 | B2 | 11/2009 | Becker et al. | |
| 2001/0003542 | A1 | 6/2001 | Kita | |
| 2001/0039872 | A1 * | 11/2001 | Cliff | 84/609 |
| 2002/0043149 | A1 * | 4/2002 | Barlay | 84/470 R |
| 2002/0091049 | A1 | 7/2002 | Hisano et al. | |
| 2002/0091796 | A1 | 7/2002 | Higginson et al. | |
| 2003/0037664 | A1 * | 2/2003 | Comair et al. | 84/609 |
| 2003/0183064 | A1 * | 10/2003 | Eugene et al. | 84/609 |
| 2004/0069123 | A1 | 4/2004 | Becker et al. | |
| 2005/0049113 | A1 | 3/2005 | Yueh et al. | |
| 2005/0051021 | A1 * | 3/2005 | Laakso | 84/615 |
| 2005/0126370 | A1 | 6/2005 | Takai et al. | |
| 2005/0129253 | A1 | 6/2005 | Chen | |
| 2005/0141729 | A1 | 6/2005 | Kanzaki et al. | |
| 2006/0048634 | A1 | 3/2006 | Lu et al. | |
| 2006/0084551 | A1 | 4/2006 | Volpe, Jr. | |
| 2006/0102171 | A1 | 5/2006 | Gavish | |
| 2006/0107822 | A1 | 5/2006 | Bowen | |
| 2006/0111621 | A1 | 5/2006 | Coppi et al. | |
| 2006/0112810 | A1 * | 6/2006 | Eves et al. | 84/609 |
| 2006/0169125 | A1 | 8/2006 | Ashkenazi et al. | |
| 2006/0243120 | A1 | 11/2006 | Takai et al. | |
| 2006/0253210 | A1 | 11/2006 | Rosenberg | |
| 2006/0276919 | A1 | 12/2006 | Shirai et al. | |
| 2006/0288846 | A1 | 12/2006 | Logan | |
| 2007/0006708 | A1 * | 1/2007 | Laakso | 84/1 |
| 2007/0027000 | A1 | 2/2007 | Shirai et al. | |
| 2007/0044641 | A1 | 3/2007 | McKinney et al. | |
| 2007/0060446 | A1 | 3/2007 | Asukai et al. | |
| 2007/0074618 | A1 | 4/2007 | Vergo | |
| 2007/0074619 | A1 | 4/2007 | Vergo | |
| 2007/0079691 | A1 | 4/2007 | Turner | |
| 2007/0113725 | A1 | 5/2007 | Oliver et al. | |
| 2007/0169614 | A1 | 7/2007 | Sasaki et al. | |
| 2008/0066609 | A1 | 3/2008 | Bourgeois | |
| 2008/0072741 | A1 | 3/2008 | Ellis | |
| 2008/0190267 | A1 * | 8/2008 | Rechsteiner et al. | 84/609 |
| 2008/0236369 | A1 | 10/2008 | Sasaki | |
| 2008/0236370 | A1 * | 10/2008 | Sasaki et al. | 84/612 |
| 2008/0314232 | A1 * | 12/2008 | Hansson et al. | 84/625 |
| 2009/0019994 | A1 * | 1/2009 | McKinney | 84/612 |
| 2009/0044689 | A1 | 2/2009 | Komori et al. | |
| 2009/0048694 | A1 | 2/2009 | Matsuda et al. | |
| 2009/0049979 | A1 * | 2/2009 | Naik et al. | 84/636 |
| 2009/0056526 | A1 | 3/2009 | Yamashita et al. | |
| 2009/0133568 | A1 | 5/2009 | Miyajima et al. | |
| 2009/0223352 | A1 | 9/2009 | Matsuda et al. | |
| 2009/0272253 | A1 | 11/2009 | Yamashita et al. | |
| 2010/0031804 | A1 * | 2/2010 | Chevreau et al. | 84/609 |
| 2010/0229094 | A1 * | 9/2010 | Nakajima et al. | 715/727 |

FOREIGN PATENT DOCUMENTS

| | | | |
|---|---|---|---|
| JP | 9-230880 | A | 9/1997 |
| JP | 10-11463 | A | 1/1998 |
| JP | 11-3077 | A | 1/1999 |
| JP | 2001-299980 | A | 10/2001 |
| JP | 2007-156280 | A | 6/2007 |

OTHER PUBLICATIONS

Office Action, mailed on Jan. 27, 2009, issued in corresponding JP 2007-085510.

Office Action, mailed on Jan. 27, 2009, issued in JP 2007-085508, the corresponding JP application for related co-pending application U.S. Appl. No. 12/057,293 (US 2008-0236369).

* cited by examiner

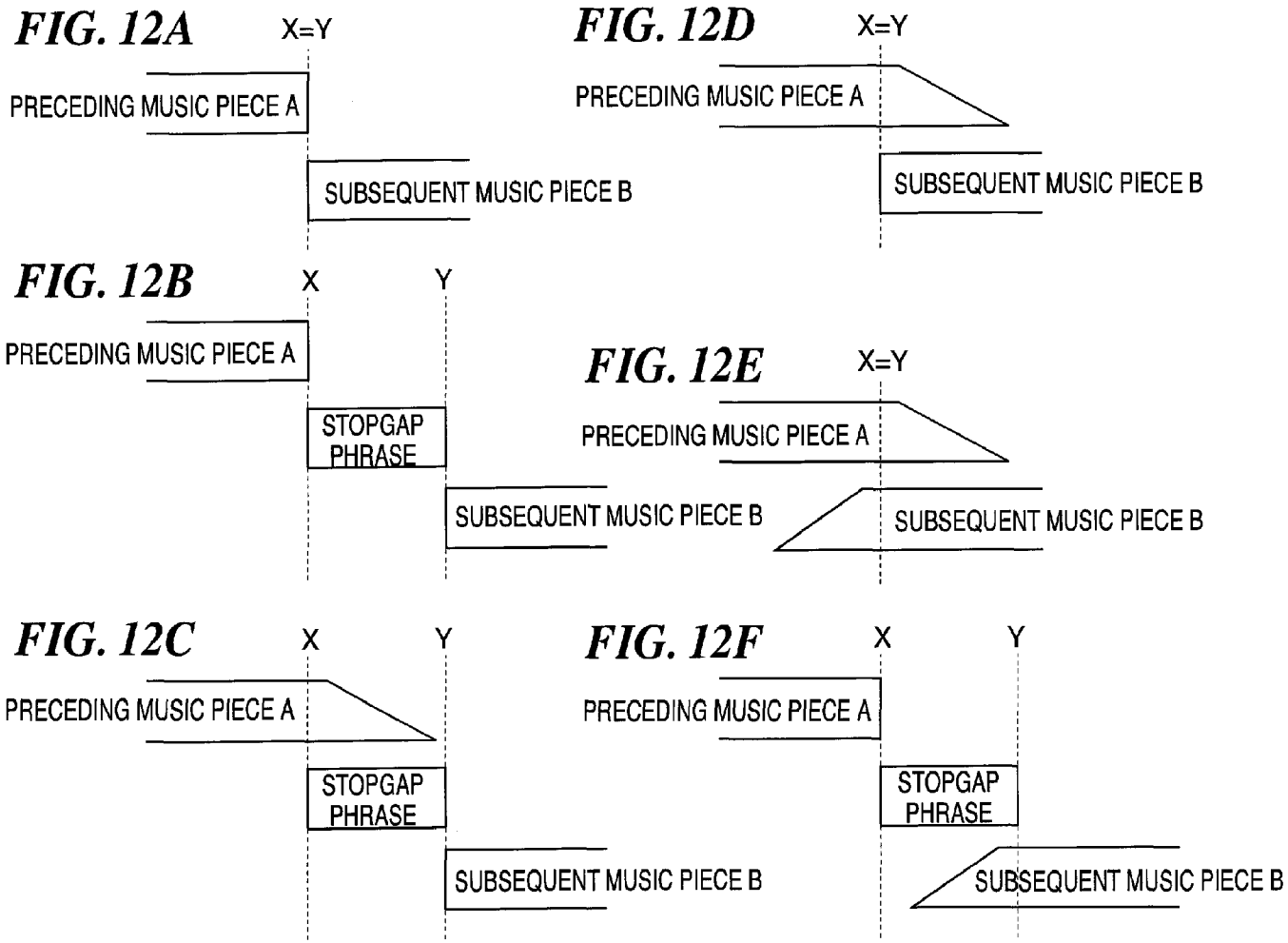
FIG. 12A
PRECEDING MUSIC PIECE A
X=Y
SUBSEQUENT MUSIC PIECE B
FIG. 12B
PRECEDING MUSIC PIECE A
X
Y
STOPGAP PHRASE
SUBSEQUENT MUSIC PIECE B
FIG. 12C
PRECEDING MUSIC PIECE A
X
Y
STOPGAP PHRASE
SUBSEQUENT MUSIC PIECE B
FIG. 12D
PRECEDING MUSIC PIECE A
X=Y
SUBSEQUENT MUSIC PIECE B
FIG. 12E
PRECEDING MUSIC PIECE A
X=Y
SUBSEQUENT MUSIC PIECE B
FIG. 12F
PRECEDING MUSIC PIECE A
X
Y
STOPGAP PHRASE
SUBSEQUENT MUSIC PIECE B

PERFORMANCE APPARATUS AND STORAGE MEDIUM THEREFOR

CROSS REFERENCE TO RELATED APPLICATION

This application is a divisional of and claims priority to U.S. patent application Ser. No. 12/057,317 filed Mar. 27, 2008, the entire content of which is incorporated herein by reference.

BACKGROUND OF THE INVENTION

1. Field of the Invention

The present invention relates to a performance apparatus for use by a user in performing an exercise, dance or the like to the rhythm of music, and relates to a computer-readable storage medium in which a program for executing a method for controlling the performance apparatus is stored.

2. Description of the Related Art

A performance apparatus used by a user for performing an exercise, dance or the like to the rhythm of music is conventionally known.

For example, such a performance apparatus is configured to generate a time-dependent target pulse rate pattern for a time period from start to end of a user's exercise based on the intensity of exercise or other conditions which are input to the apparatus, detect the pulse rate of the user performing the exercise in time with the reproduction of selected music data, calculate a correction value for correcting the tempo of music data based on the user's exercise tempo and a difference between the target and detected pulse rates, and correct the tempo of music data with the correction value (for example, see Japanese Laid-open Patent Publication No. 2001-299980).

This conventional performance apparatus discloses a technical concept of reproducing selected music data in a corrected tempo, but does not disclose nor suggest a technical concept of making a shift from reproduction of music data to reproduction of different music data.

When, for example, music data whose reproduction time is several minutes is reproduced during the user's exercise of several ten minutes, the same music data is repeatedly reproduced about ten times during the exercise, making the user to get tired of the music. It is therefore preferable that a plurality of music pieces should sequentially be reproduced during the exercise. This also applies to a case where music data is reproduced in a corrected tempo as in the above described performance apparatus. If the reproduction of music data being reproduced can be changed over to the reproduction of different music data stored in the performance apparatus, the user is encouraged to make efforts to perform the exercise for a long time with a fresh mind.

Upon changeover of music pieces during the exercise, music pieces must be reproduced without any discontinuity so as not to hinder the exercise. To this end, a cross-fade technique is frequently used to connect a preceding music piece to a subsequent music piece without discontinuity. However, when music pieces are crossfade-connected, a deviation is often produced between the beat of the preceding music piece and the beat of the subsequent music piece, which disturbs the rhythm of exercise or dance.

SUMMARY OF THE INVENTION

The present invention provides a performance apparatus capable of changing reproduction of a music piece over to reproduction of a different music piece without disturbing the rhythm of exercise, dance, or the like performed by a user to the rhythm of music, and provides a computer-readable storage medium storing a program for executing a method for controlling the performance apparatus.

According to a first aspect of this invention, there is provided a performance apparatus comprising storage unit adapted to store a plurality of performance data, a selection unit adapted to select any of the plurality of performance data stored in the storage unit, a reproduction unit adapted to reproduce performance data selected by the selection unit, a control unit adapted to control said reproduction unit such that performance data being reproduced by the reproduction unit is changed over to another performance data selected by the selection unit and performance data reproduction is continuously carried out, and a beat position acquisition unit adapted to acquire a beat position in preceding performance data used for performance data reproduction before changeover controlled by the control unit, and acquire a beat position in subsequent performance data used for performance data reproduction after the changeover, wherein the control unit is adapted to control the changeover such that the beat position in the preceding performance data matches the beat position in the subsequent performance data.

With the performance apparatus according to the first aspect of this invention, upon changeover from the preceding performance data to the subsequent performance data, the changeover is carried out such that the beat position in the preceding performance data matches the beat position in the subsequent performance data. Thus, when a user performs exercise, dance, or the like to the rhythm of music, the changeover and reproduction of music can be carried out without disturbing the rhythm of the user's exercise or dance.

The performance apparatus can further include a transmission/reception unit adapted to be connected to an external unit for data transmission and data reception to and from the external unit, and a data acquisition unit adapted to acquire, from the external unit via the transmission/reception unit, pieces of performance data and pieces of beat position data each indicating a beat position in a corresponding one of the performance data in terms of time. The storage unit can be adapted to store the performance data acquired by the acquisition unit and also store the beat position data corresponding to the performance data. The beat position acquisition unit can be adapted to acquire the beat position in the preceding performance data and the beat position in the subsequent performance data from the beat position data stored in the storage unit.

In this case, performance data and beat position data representative of beat positions in the performance data in terms of time are acquired from the external unit and stored in the storage unit, and the beat position in preceding performance data and the beat position in subsequent performance data are acquired from the stored beat position data. As a result, the performance apparatus is not required to have a high calculation processing ability, whereby fabrication costs can be reduced.

According to a second aspect of this invention, there is provided a performance apparatus comprising a storage unit adapted to store a plurality of performance data, a selection unit adapted to select any of the plurality of performance data stored in the storage unit, a first reproduction unit adapted to reproduce performance data selected by the selection unit, a control unit adapted to control the first reproduction unit such that performance data being reproduced by the first reproduction unit is changed over to another performance data selected by the selection unit and performance data reproduction is continuously carried out, a musical tone characteristic acquisition unit adapted to acquire a musical tone characteristic of at least one of preceding performance data used for performance data reproduction before changeover controlled by the control unit and subsequent performance data used for performance data reproduction after the changeover, a generation unit adapted, based on the musical tone characteristic acquired by the musical tone characteristic acquisition unit, to generate stopgap performance data for connecting between the preceding performance data and the subsequent performance data, and a second reproduction unit adapted to reproduce the stopgap performance data generated by the generation unit, wherein the control unit is adapted to control the second reproduction unit such that the stopgap performance data is inserted between the preceding performance data and the subsequent performance data and is reproduced.

With the performance apparatus according to the second aspect of this invention, the musical tone characteristic of at least one of the preceding performance data and the subsequent performance data is acquired, and in accordance with the acquired characteristic, stopgap performance data used for connection between the preceding and subsequent performance data is generated and inserted therebetween for reproduction. As a result, the preceding performance data can smoothly be connected to the subsequent performance data, and therefore, when a user performs exercise, dance, or the like to the rhythm of music, the changeover and reproduction of music can be carried out without disturbing the rhythm of the user's exercise or dance.

The musical tone characteristic acquisition unit can be adapted to acquire musical tone characteristics of both the preceding performance data and the subsequent performance data, and the generation unit can be adapted to generate stopgap performance data that varies from the musical tone characteristic of the preceding performance data to the musical tone characteristic of the subsequent performance data with elapse of time.

In this case, both the musical tone characteristic of the preceding performance data and that of the subsequent performance data are acquired, and stopgap performance data varying from the musical tone characteristic of the preceding performance to the musical tone characteristic of the subsequent performance data is generated. As a result, the preceding performance data can further be smoothly connected to the subsequent performance data.

The performance apparatus can further include a stopgap performance data storage unit adapted to store a plurality of the stopgap performance data, and the generation unit can be adapted, based on the musical tone characteristic acquired by the musical tone characteristic acquisition unit, to select the stopgap performance data from among the plurality of the stopgap performance data stored in the stopgap performance data storage unit.

In this case, the stopgap performance data is selected by the generation unit from among the data stored in the stopgap performance data storage unit in accordance with the acquired musical tone characteristic, and therefore, it is unnecessary for the generation unit to generate the stopgap performance data. As a result, the performance apparatus is not required to have a high calculation processing ability, whereby fabrication costs can be reduced.

The performance apparatus can further include a transmission/reception unit adapted to be connected to an external unit for data transmission and data reception to and from the external unit, and a data acquisition unit adapted to acquire, from the external unit via the transmission/reception unit, pieces of performance data and pieces of musical tone characteristic data each indicating a musical tone characteristic of a corresponding one of the performance data. The storage unit can be adapted to store the performance data acquired by the acquisition unit and also store the musical tone characteristic corresponding to the performance data, and the musical tone characteristic acquisition unit can be adapted to acquire the musical tone characteristic of at least one of the preceding performance data and the subsequent performance data from the musical tone characteristic data stored in the storage unit.

In this case, musical tone characteristic data indicating the musical tone characteristic of performance data are acquired from the external unit and stored in the storage unit, and the musical tone characteristic of at least one of the preceding and subsequent performance data is acquired from the stored musical tone characteristic data. As a result, the performance apparatus is not required to have a high calculation processing ability, whereby fabrication costs can be reduced.

According to a third aspect of this invention, there is provided a computer-readable storage medium storing a program for causing a computer to execute a method for controlling a performance apparatus including a storage unit storing a plurality of performance data, the method comprising a selection step of selecting any of the plurality of performance data stored in the storage unit, a reproduction step of reproducing performance data selected in the selection step, a control step of controlling the reproduction step such that performance data being reproduced in the reproduction step is changed over to another performance data selected in the selection step and performance data reproduction is continuously carried out, and a beat position acquisition step of acquiring a beat position in preceding performance data used for performance data reproduction before changeover controlled by the control step, and acquire a beat position in subsequent performance data used for performance data reproduction after the changeover, wherein the control step controls the changeover such that the beat position in the preceding performance data matches the beat position in the subsequent performance data.

According to a fourth aspect of this invention, there is provided a computer-readable storage medium storing a program for causing a computer to execute a method for controlling a performance apparatus including a storage unit storing a plurality of performance data, the method comprising a selection step of selecting any of the plurality of performance data stored in the storage unit, a first reproduction step of reproducing performance data selected in the selection step, a control step of controlling the first reproduction step such that performance data being reproduced in the first reproduction step is changed over to another performance data selected in the selection step and performance data reproduction is continuously carried out, a musical tone characteristic acquisition step of acquiring a musical tone characteristic of at least one of preceding performance data used for performance data reproduction before changeover controlled by the control step and subsequent performance data used for performance data reproduction after the changeover, a generation step of generating, based on the musical tone characteristic acquired in the musical tone characteristic acquisition step, stopgap performance data for connecting between the preceding performance data and the subsequent performance data, and a second reproduction step of reproducing the stopgap performance data generated in the generation step, wherein the control step controls the second reproduction step such that the stopgap performance data is inserted between the preceding performance data and the subsequent performance data and is reproduced.

Further features of the present invention will become apparent from the following description of an exemplary embodiment with reference to the attached drawings.

BRIEF DESCRIPTION OF THE DRAWINGS

FIGS. 11A to 11C are views for explaining the way of how a music data changeover position is determined upon changeover from music data currently reproduced to selected music data, wherein FIG. 11A shows how a preceding music piece is faded out when the preceding music piece is reproduced up to near the end of music data and is changed over to the next music data, FIG. 11B shows how a subsequent music piece is faded-in, and FIG. 11C shows a case where the changeover to the next music data is performed in the midst of reproduction of music; and FIGS. 12A to 12F are views for explaining connection methods which can be selected by the music player shown in FIG. 1, wherein FIG. 12A shows an example where the changeover to the next music data is carried out in the midst of music reproduction, FIG. 12B shows an example where the reproduction of a preceding music piece is changed over to the reproduction of a stopgap phrase and to the reproduction of a subsequent music piece, FIG. 12C shows an example where the stopgap phrase is reproduced with the preceding music piece faded out and then the reproduction of the stopgap phrase is changed over to the reproduction of a subsequent music piece, FIG. 12D shows an example where the preceding music piece is faded out but the subsequent music piece is not faded in, FIG. 12E shows an example where the preceding music piece is faded out and the subsequent music piece is faded in, and FIG. 12F shows an example where the reproduction of the preceding music piece is changed over to the reproduction of the stopgap phrase and to the reproduction of the subsequent music piece while the subsequent music piece is faded in.

DETAILED DESCRIPTION OF THE PREFERRED EMBODIMENT

The present invention will now be described in detail below with reference to the drawings showing a preferred embodiment thereof.

Figure 1:
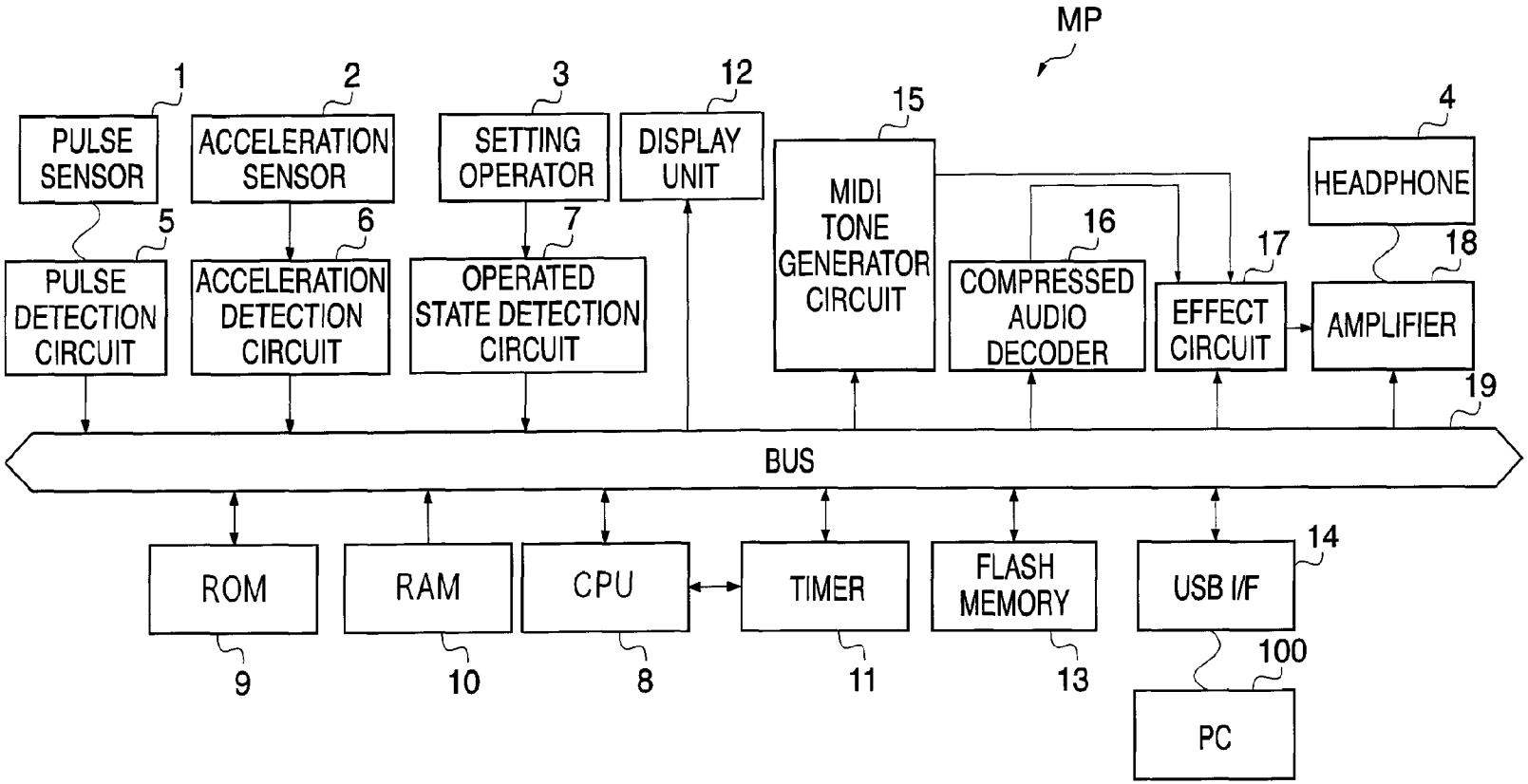
FIG. 1 is a block diagram schematically showing the construction of a portable music player to which a performance apparatus according to one embodiment of this invention is applied.

FIG. 1 schematically shows in block diagram the construction of a portable music player MP to which a performance apparatus according to one embodiment of this invention is applied.

As shown in FIG. 1, the music player MP includes a pulse sensor 1 for detecting a user's pulse, an acceleration sensor 2 for detecting a user's exercise state, a setting operator 3 including a plurality of switches, a headphone 4, a pulse detection circuit 5 for detecting a pulse based on an output from the pulse sensor 1, an acceleration detection circuit 6 for detecting x-, y- and z-axis direction accelerations based on an output from the acceleration sensor 2, an operated state detection circuit 7 for detecting operated states of the respective switches of the setting operator 3, a CPU 8 for controlling the entire apparatus, a ROM 9 for storing control programs executed by the CPU 8, various table data, etc., a RAM 10 for temporarily storing music data, various input information, computation results, etc., a timer 11 for measuring an interrupt time period for timer interrupt processing and various time periods, a display unit 12 for displaying various information, etc., which is comprised, for example, of a liquid crystal display (LCD), light emitting diodes (LEDs), and the like, a flash memory 13 for storing various application programs including the control programs, various music data, various data, etc., an USB I/F (universal serial bus interface) 14 for transmitting and receiving data to and from a PC (personal computer) 100 which is an external device connected thereto, a MIDI tone generator circuit 15 for converting music data consisting of MIDI data among the stored music data into musical tone signals, a compressed audio decoder 16 for expanding and converting music data consisting of compressed audio data among the stored music data into musical tone signals, an effect circuit 17 for adding various effects on musical tone signals which are output from the MIDI tone generator circuit 15 and the compressed audio decoder 16, and an amplifier 18 for amplifying musical tone signals supplied from the effect circuit 17.

The above described elements 5 to 18 are connected to a bus 19. The MIDI tone generator circuit 15 and the compressed audio decoder 16 are connected to the effect circuit 17 which is connected to the amplifier 18. The headphone 4 is connected to the amplifier 18.

The pulse sensor 1 is attached to user's earlap, hand, finger, or the like, and adapted to output a signal in synchronism with the user's pulse. In this embodiment, the pulse sensor 1 is provided in an earmuff part of the headphone 4 for detection of the user's pulse. Needless to say, the pulse sensor 1 may be attached to or provided in any other part than headphone earmuff so long as it can detect the pulse without hindering user's exercise.

The acceleration sensor 2 is provided in a housing of the music player MP. Since the music player MP is attached to the user's waist or the like as described below, vertical and horizontal accelerations are produced in the music player MP while the user is performing exercise, and are detected by the acceleration sensor 2. It should be noted that the acceleration sensor 2 is not limited to being incorporated in the music player MP, but may be configured separately from the music player MP.

The flash memory 13 can be adapted to store control programs for execution by the CPU 8, as described above. In the case of such control programs not being stored in the ROM 9, the control programs can be stored in the flash memory 13. By reading the control programs from the flash memory 13 into the RAM 10, it is possible to cause the CPU 8 to make actions similarly to the case where the control programs are stored in the ROM 9. In that case, the control programs can easily be added and version upgraded.

Figure 2A:
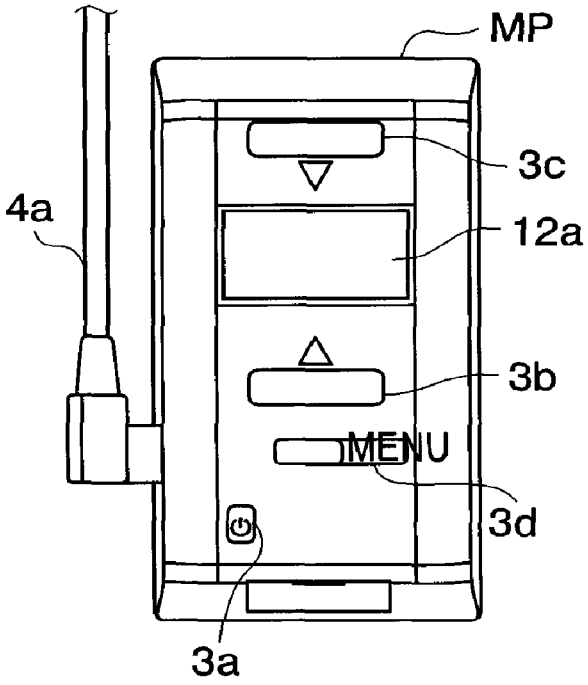
FIG. 2A is a view showing the external appearance of the musical player schematically shown in FIG. 1.
Figure 2B:
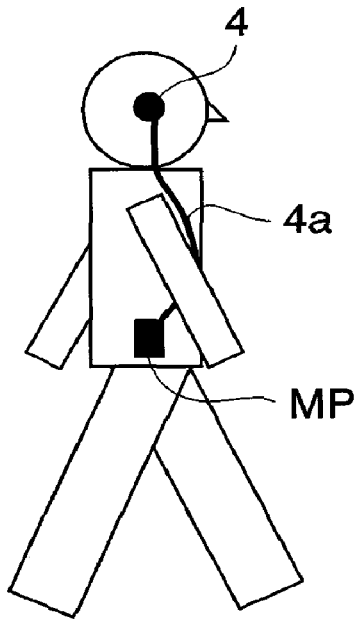
FIG. 2B is a view showing an example of how the music player is attached to user's body.

FIGS. 2A and 2B respectively show the external appearance of the music player MP and an example of how the music player MP is attached to user's body.

As shown in FIG. 2A, a plurality of switches 3*a* to 3*d* and an LCD 12*a* are provided in a panel surface of the music player MP. The switch 3*a* is a power button for turning on and off the power supply, the switch 3*b* is a pace-up button for speeding up the music tempo to speed up the exercise pace, the switch 3*c* is a pace-down button for slowing down the music tempo to slow down the exercise pace, and the switch 3*d* is a menu button to cause a menu to be displayed on the LCD 12*a*. Menu items and parameters can be selected by the switches 3*b* and 3*c*. By simultaneously pressing the switches 3*b* and 3*c*, the user can give the music player MP instructions for approval, reproduction, and stop. The headphone 4 is connected via a cable 4*a* to a headphone jack (not shown) which is connected to the amplifier 18.

The music player MP is attached to the user's waist via a belt, for example. FIG. 2B shows an example of how the music player MP is attached to the user's waist. The music player MP can be, of course, attached to any part of the user's body other than the waist. In this embodiment, the music player MP is for assisting the user's exercise, and therefore, the music player MP should be attached to a body part where it does not hinder the user's exercise.

Figure 3:
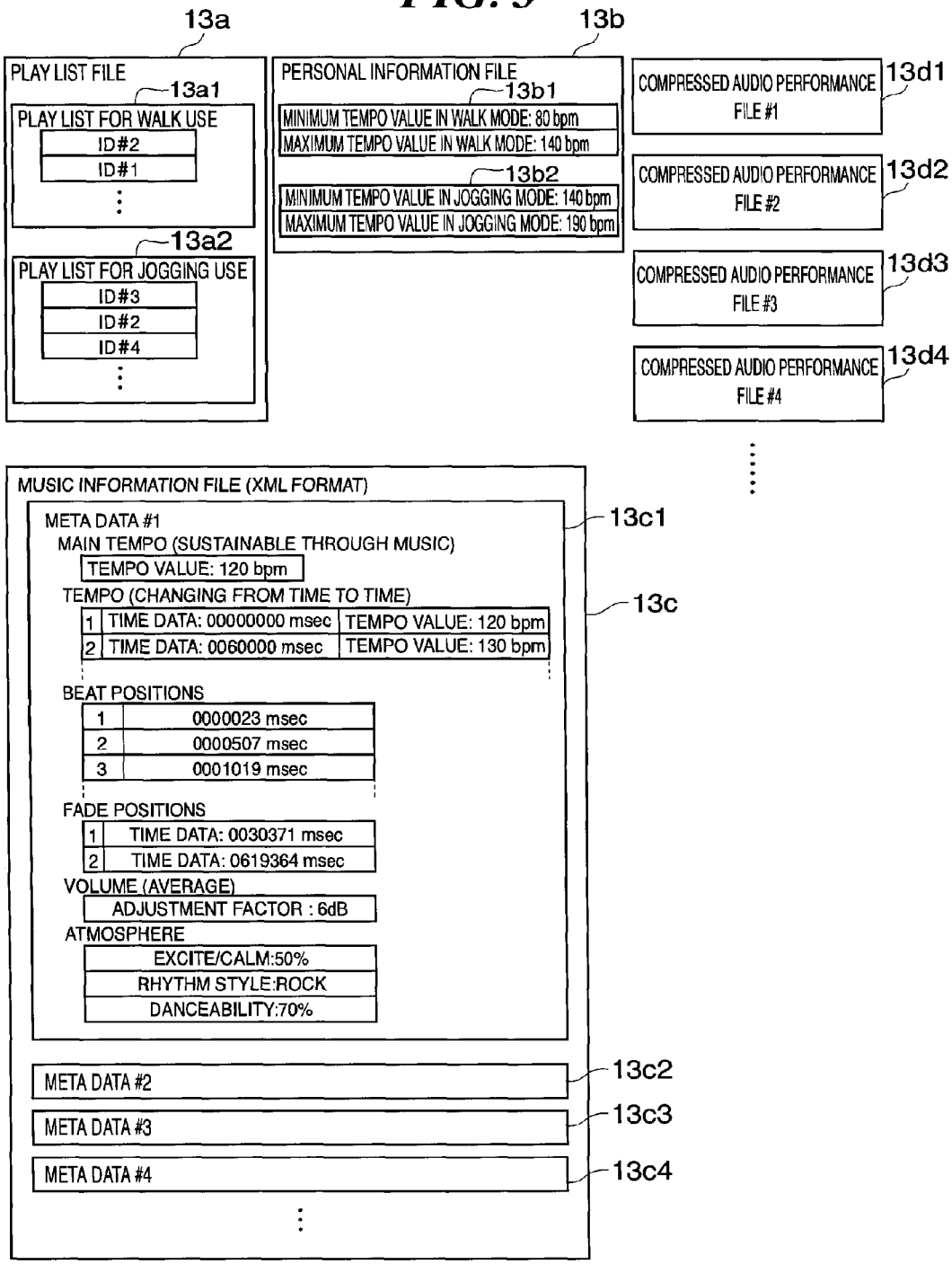
FIG. 3 is a view showing a part of files stored in a flash memory shown in FIG. 1.

FIG. 3 shows a part of data stored in the flash memory 13. The data part shown in FIG. 3 includes a play list file 13*a*, a personal information file 13*b*, a music information file 13*c*, and compressed audio performance files 13*dn* (n=1, 2, . . . ).

The play list file 13*a* includes a play list 13*a*1 for walk use and a play list 13*a*2 for jogging use. Each of the play lists is a tabulated list in which pieces of reproducible (performable) music are listed. In some music player other than the music player MP of this embodiment, pieces of reproducible music and the order of reproduction thereof are listed in the play list. On the other hand, in the play list of this embodiment, pieces of reproducible music are only listed, with the order of reproduction thereof omitted. The play list 13*a*1 for walk use is a tabulated list in which pieces of music selected for use in walk mode are included, whereas the play list 13*a*2 for jogging use is a tabulated list in which pieces of music selected for use in jogging mode are included. In the play lists of this embodiment, IDs assigned to respective pieces of music (compressed audio performance files 13*dn*) are registered, but this is not limitative. Alternatively, names or any others may be registered so long as respective pieces of music can be specified. In this embodiment, there are only shown two types of operation modes, i.e., the walk mode and the jogging mode, for the sake of simplified explanation. Actually, however, there are provided operation modes in a number corresponding to the number of types of exercise (normally, about ten types).

Like the play list file 13*a*, the personal information file 13*b* includes a plurality of types of personal information for selection according to the operation modes. In this embodiment, the personal information file 13*b* includes personal information 13*b*1 for walk mode and personal information 13*b*2 for jogging mode. Specifically, each personal information is a tempo range specified by minimum and maximum tempo values. Each tempo range is used to select, from among performance files 13*dn*, personal files to be registered in the play list concerned. Specifically, performance files selected from the performance files 13*dn* are registered in the play list 13*a*1 for walk use, wherein each of the selected performance files has a tempo value (=a tempo value of main point) falling within a range from 80 bpm (=the minimum tempo value in walk mode) to 140 bpm (=the maximum tempo value in walk mode). On the other hand, performance files each having a tempo value (=a tempo value of main point) falling within a range from 140 bpm (=the minimum tempo value in jogging mode) to 190 bpm (=the maximum tempo value in jogging mode) and selected from the performance files 13*dn* are registered in the play list 13*a*2 for jogging use.

The music information file 13*c* includes pieces of meta data 13*cn* (n=1, 2, . . . ) respectively corresponding to the performance files 13*dn*. Each of the pieces of meta data 13*cn* includes a main point which remains substantially unchanged through the music concerned, tempos which change from time to time, beat positions, fade positions, and so on, which are registered therein. The main point is a value representing a tempo that is most sustainable through the entire music, and is a tempo value that represents the entire music. The main point is used for the selection of music data to be registered in the play list and for the selection, from among the music data registered in the play list, of music data to be reproduced. The beat positions represent positions of beats of from beginning to end of music in terms of time measured from the beginning of music. Typically, the beat positions represent time-based positions of every beat, but may represent time-based positions of every plural beats (for example, every four beats). The beat positions, fade positions, sound volumes, and atmosphere of music are used for making a shift from the reproduction of the music piece concerned to the reproduction of another music piece. This invention is characterized in the way of how the music reproduction is changed over based on beat position data and the like, and detailed procedures therefor will be described later.

The performance files 13*dn* each consist of compressed audio performance data. Any compression method can be used for audio performance data compression. There may be mentioned, for example, MP3 (MPEG audio layer 3), WMA (Windows (registered trademark) media audio), AAC (advanced audio coding), etc. Compressed audio performance data on which the performance files 13*dn* are based are acquired by the PC 100, as described below with reference to FIG. 7. Upon acquisition of compressed audio performance data, the PC 100 analyzes the content of the data, and produces meta data corresponding to the compressed audio performance data.

In the following, a control process for execution by the music player MP constructed as described above will be schematically described with reference to FIG. 4 and FIGS. 12A to 12F, and then described in detail with reference to FIG. 5 to FIGS. 12A to 12F.

The music player MP mainly carries out the following processes.

(A) A music selection/reproduction process, in which pieces of music are selected and reproduced such as to change the user's heart rate along an optimal heart rate curve; and (B) A pace change process to change the exercise pace in accordance with user's operations of the pace up/down buttons 3*b*, 3*c*.

Figure 4:
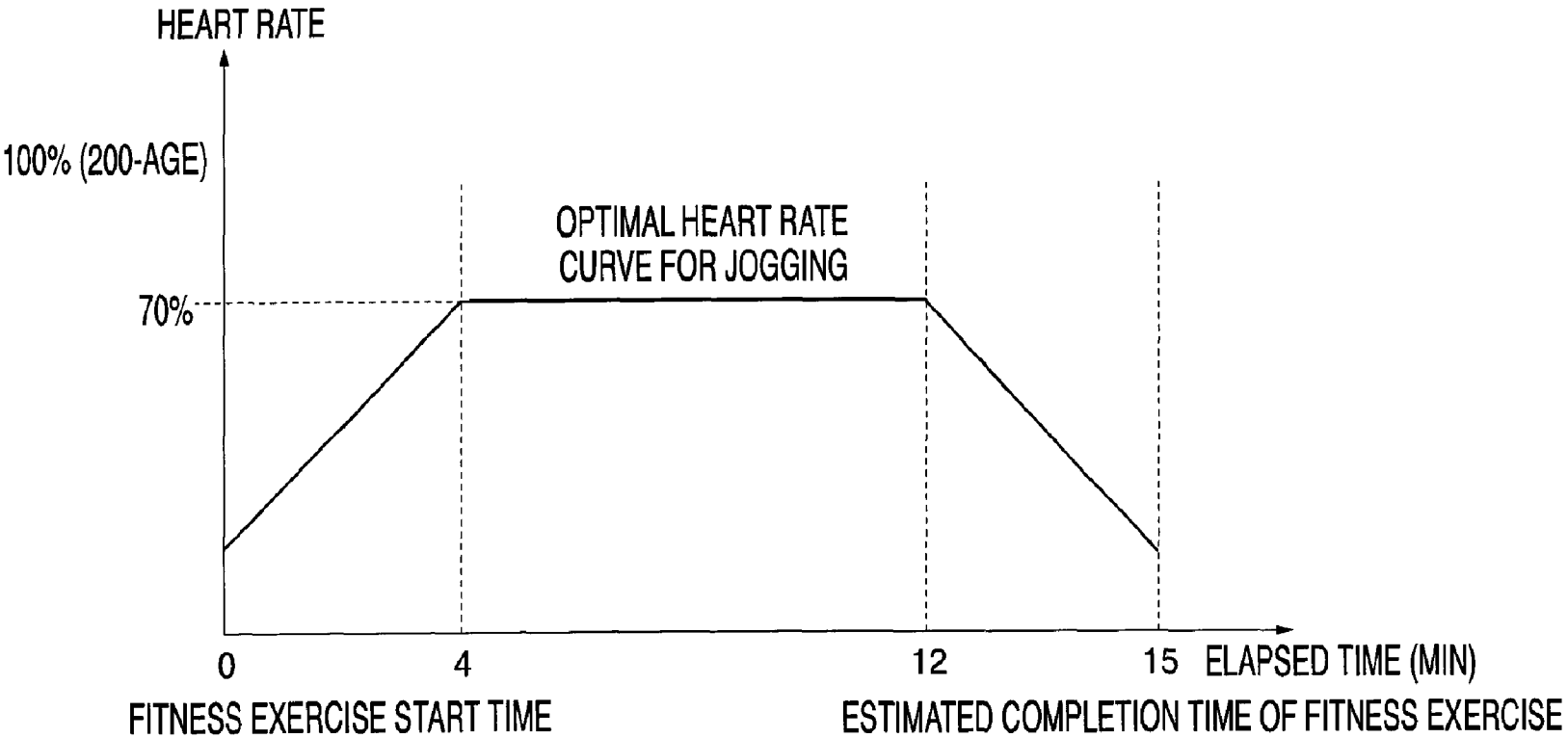
FIG. 4 is a view showing an example of an optimal heart rate curve in a jogging mode.

When an instruction to start fitness exercise is given by the user to the music player MP, the CPU 8 causes the process to proceed to the music selection/reproduction process (A) in which an optimal heart rate curve is calculated based on current settings. It is assumed here that the jogging mode has been set as the operation mode. FIG. 4 shows an example of the optimal heart rate curve calculated in a state that the jogging mode is set. Next, the CPU 8 sets an initial value of the target tempo to the minimum tempo value in the jogging mode, i.e., 140 bpm (see FIG. 3), searches for music having a tempo corresponding to the target tempo from the play list 13*a*2 for jogging use. As a result of the search, if intended music is present in the play list 13*a*2 for jogging use, the CPU 8 selects the intended music, i.e., one of the compressed audio performance files 13*dn* (n=1, 2, . . . ), and gives an instruction to reproduce the selected music to the compressed audio decoder 16. On the other hand, as a result of the search, if the intended music is not present in the play list 13*a*2 for jogging use, the CPU 8 produces, in the MIDI data format, music having a tempo corresponding to the target tempo, selects the produced music data, and gives an instruction to reproduce the produced music data to the MIDI tone generator circuit 15.

When the selected music data is continued to be reproduced for a predetermined time period (30 seconds, for example), the CPU 8 detects user's pulse (=heart rate) via the pulse detection circuit 5, and calculates a difference between the detected heart rate and a target heart rate (i.e., a heart rate on the optimal heart rate curve at a given elapsed time from the start of fitness exercise). If the difference between the detected and target heart rates falls outside a predetermined range (in which the difference does not vary more than plus or minus 3% from the target heart rate, for example), the CPU 8 changes the target tempo such as to decrease the difference therebetween. Specifically, when the detected heart rate is more than 3% larger than the target heart rate, the CPU 8 decreases the target tempo by 5%. On the other hand, when the detected heart rate is more than 3% smaller than the target heart rate, the target tempo is increased by 5%. Then, the CPU 8 newly selects music in accordance with the target tempo having been changed as described above. As a result, the target tempo is adjusted such that the user's heart rate is made along the optimal heart rate curve, and pieces of music each having a tempo corresponding to the target tempo are selected and reproduced in sequence until completion of the fitness exercise.

One of features of this invention resides in that upon changeover of selected music data, the beat of a preceding music piece and that of a subsequent music piece are made to match each other. As a result, a shift from the reproduction of the preceding music piece to the reproduction of the subsequent music piece can smoothly be carried out, and therefore, the rhythm of a user's exercise or dance is not disturbed even at the changeover of music. In this embodiment, there are provided six types of the way of matching the beat of the preceding music piece to the beat of the subsequent music piece, i.e., six types of methods for connecting them, as shown in FIGS. 12A to 12F. These methods for music piece connection are given respective names. When any of the names is selected by the user, selected music data are connected by the method having the selected name.

When the pace up/down button 3*b* or 3*c* is operated by the user during the fitness exercise, the CPU 8 causes the process to proceed to the pace change process (B), in which the target tempo is increased or decreased by a predetermined value (5%, for example). Then, the CPU 8 determines whether or not the pace up/down button 3*b* or 3*c* has been operated in predetermined timing. If it is determined that the button has been operated in the predetermined timing, the personal information 13*b*2 is changed. Therefore, in accordance with the user's instruction, the music is reproduced in the tempo after the change and the personal information is updated in a predetermined timing. It should be noted that the changeover to the reproduction of the music piece having been changed in tempo is also carried out by the selected connection method.

Next, the control process is explained in detail below.

Figure 5A:
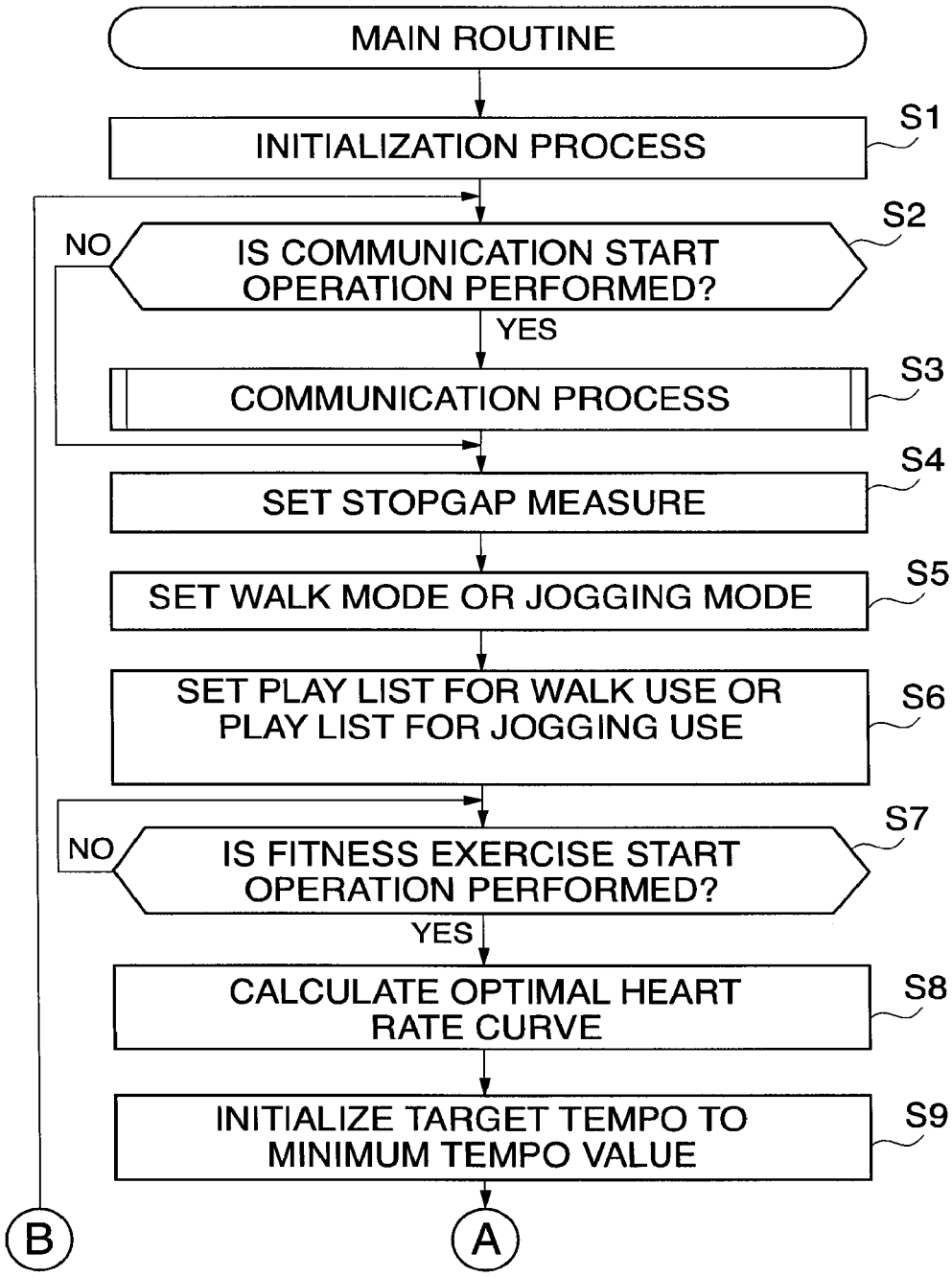
FIGS. 5A and 5B are a flowchart showing the procedure of a main routine executed by the music player shown in FIG. 1, particularly by a CPU thereof.
Figure 5B:
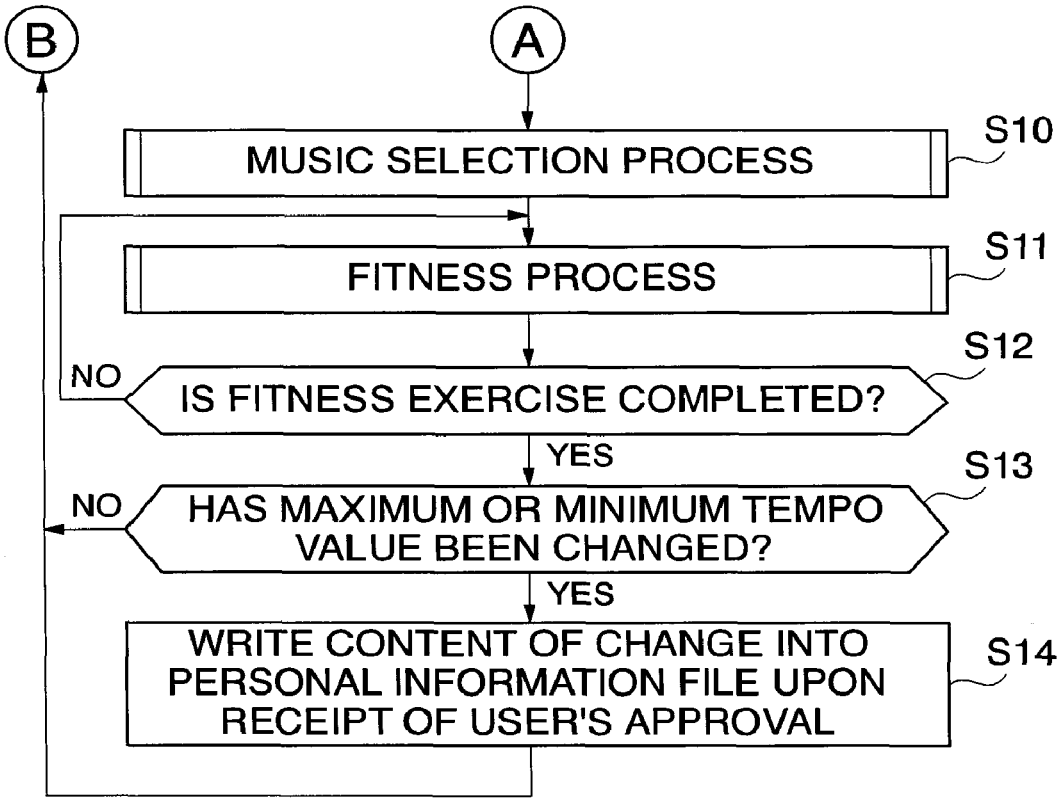

FIGS. 5A and 5B show in flowchart the procedure of the main routine executed by the music player MP, especially, by the CPU 8 thereof.

In the main routine, the CPU 8 mainly performs the following processes.

(1) An initialization process (step S1);

(2) A communication process with the PC 100 (step S3);

(3) A process before the start of fitness exercise (steps S4 to S6);

(4) A process at the start of fitness exercise (steps S8 to S10);

(5) A fitness process (step S11); and (6) A process upon completion of fitness exercise (steps S13 and S14).

The main routine is started when power is turned on by the power button 3*a*. Upon start of the main routine, the initialization process (1) is executed once. Subsequently, the processes (2) to (6) are executed in sequence. When the process (6) is completed, the process is returned to the process (2). Then, the processes (2) to (6) are repeatedly carried out until the power is turned off by the power button 3*a*.

In the initialization process (1), the CPU 8 performs initialization to clear the RAM 6 and sets various parameter values to default values, and so on. Initialization for the operation mode and the connection method is also performed. For example, the "walk mode" is set as the default operation mode, and an "instantaneous changeover" (see FIG. 12A) is set as a default connection method.

When a communication start operation, such as connecting the USB I/F 14 to the PC 100 via, e.g., the USB cable (not shown), is performed by a user (step S2 in FIG. 5A), the CPU 8 detects that the PC 100 is connected to the USB I/F 14 and causes the process to proceed to the communication process (2).

Figure 6:
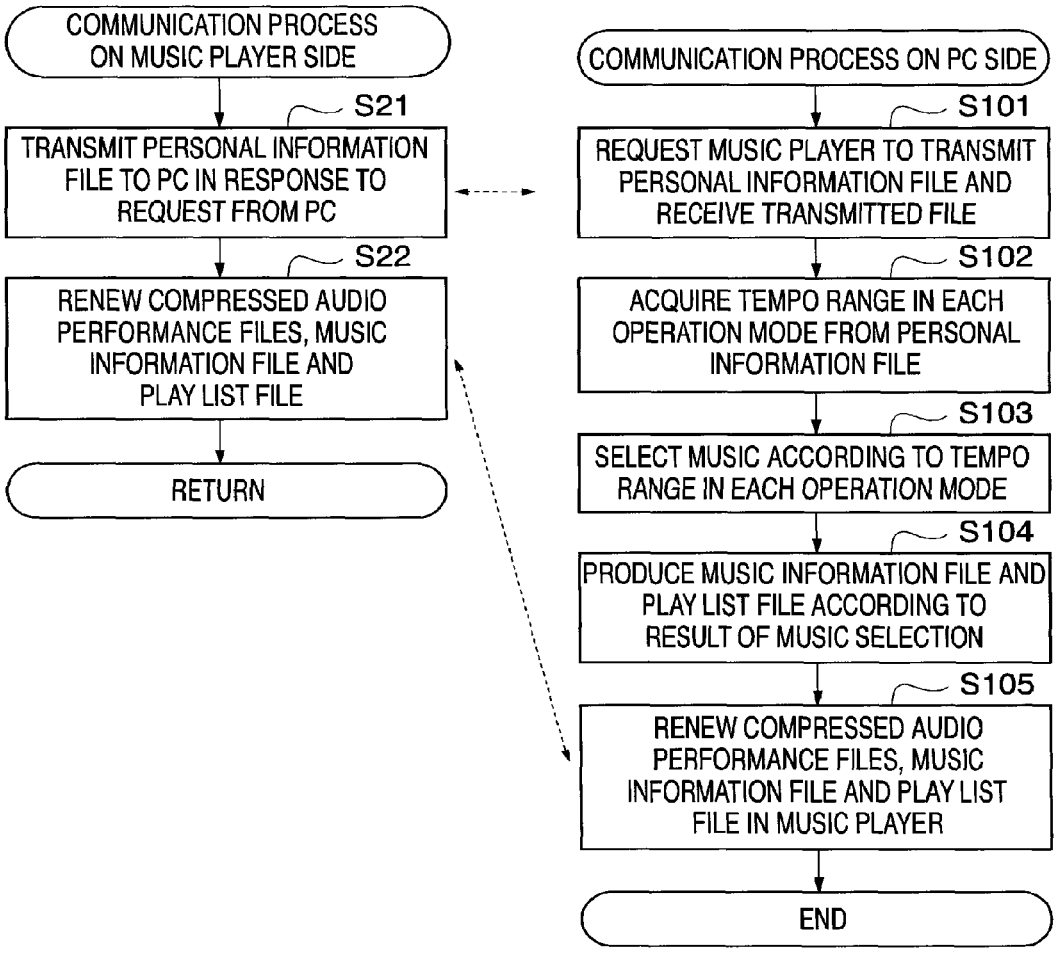
FIG. 6 is a flowchart showing in detail the procedure of a communication process shown in FIG. 5A.

FIG. 6 shows in flowchart the procedure of the communication process in detail. In FIG. 6, there are shown a communication process on the music player MP side, i.e., the communication process (2), and a communication process on the PC 100 side. It should be noted that from the PC 100 side, the music player MP connected thereto via the USB cable is recognized as an external storage unit (storage), and the PC 100 can freely read and rewrite the stored content of the flash memory 13 of the music player MP.

Since the music player MP is extremely smaller in storage capacity than the PC 100, it is impossible for the music player MP (more specifically, the flash memory 13 thereof) to store all the music data (including the compressed audio performance files 13*dn*) in all the operation modes (in this embodiment, two types of operation modes are shown by way of example, but about ten types of operation modes are provided in actuality). Thus, an immediately necessary part of music data which are stored beforehand in the PC 100 is selected and stored in the flash memory 13. A determination to determine the presence or absence of the immediate necessity of respective music data, storage of necessary music data into the flash memory 13, elimination of unnecessary music data from the flash memory 13, renewal of the play list file 13*a*, and so on are all performed on the PC 100 side. To this end, the communication process between the PC 100 and the music player MP is required.

In the communication process on the PC 100 side, a CPU (not shown) of the PC 100 performs the following processes.

(101) A process to request the music player MP to transmit the personal information file 13*b*, and receive the transmitted file 13*b* (step S101);

(102) A process to acquire a tempo range in each operation mode from the personal information file 13*b* (step S102);

(103) A process to select music data in accordance with the tempo range in each operation mode acquired by the process (102) (step S103);

(104) A process to produce the music information file 13*c* and the play list file 13*a* in accordance with a result of selection by the process (103) (step S104); and (105) A process to renew the compressed audio performance files 13*dn*, the music information file 13*c*, and the play list file 13*a* in the music player MP (specifically, in the flash memory 13 thereof) (step S105).

In the music selection process (103), music data are selected according to the tempo range specified by the minimum and maximum tempo values indicated in the personal information for each operation mode. Here, the words "according to the tempo range" do not indicate that music data having a tempo even slightly deviating from the tempo range should not be selected, but indicate that music data may be selected with some margin, for example, about 10%. As a result, when the minimum tempo value of 90 bpm and the maximum tempo value of 140 bpm are indicated in the personal information, music data each having a tempo falling within the range from 81 bpm to 154 bpm are selected.

By the music selection process (103), music data to be registered in the play list are selected for each operation mode. In the process (104), the play list for each operation mode is produced, and all the play lists are combined together to thereby produce one play list file. Since there is always present meta data corresponding to each selected music data (meta data is produced simultaneously with acquisition of music data as described below with reference to FIG. 7, and the music selection process (103) is implemented based on the content of meta data made to correspond to each music data), all the meta data corresponding to respective ones of all the selected music data are combined together to produce one music information file. IDs attached to music data are also attached to meta data, thereby maintaining a one-to-one correspondence between each of the selected music data and the meta data corresponding thereto, even if the data save destination will be changed from the PC 100 side to the music player MP.

In response to a request for transmission from the PC 100 in the process (101), the CPU 8 of the music player MP transmits the personal information file 13*b* stored in the flash memory 13 to the PC 100 via the USB I/F 14 (step S21). In response to renewal of files in the process (105), the CPU 8 renews the compressed audio performance files 13*dn*, the music information file 13*c*, and the play list file 13*a*, which are stored in the flash memory 13 (step S22).

Figure 7:
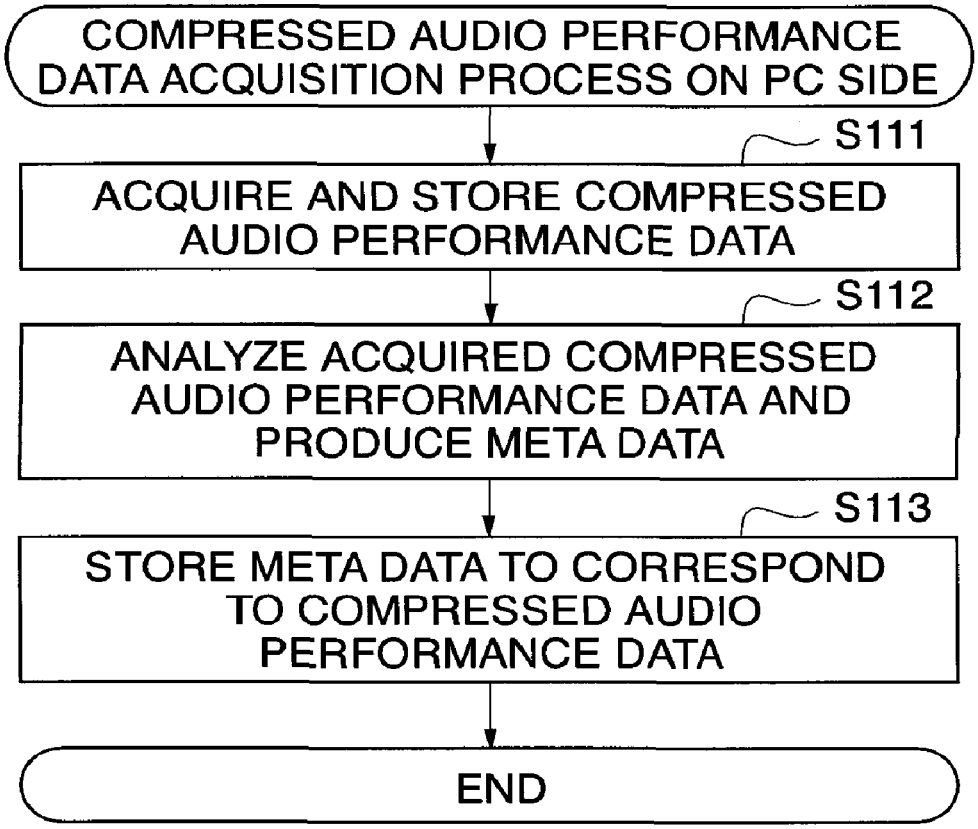
FIG. 7 is a flowchart showing the procedure performed on a PC side to acquire compressed audio performance data on which a compressed audio performance file is based.

FIG. 7 shows in flowchart the procedure of a process implemented by the PC 100 side to acquire compressed audio performance data on which the compressed audio performance files 13*dn* are based.

In accordance with, for example, a user's instruction, the CPU of the PC 100 acquires compressed audio performance data, and causes the acquired data to be stored into an external storage unit (not shown) such as an HDD (hard disk unit) (step S111). There may be several sources from which the compressed audio performance data are acquired. For example, a compressed audio performance data provider site on the Internet can be mentioned, which is of course not limitative. To acquire the compressed audio performance data, audio performance data obtained from the source of audio performance data (such as a music CD) can be compressed using software for compressing uncompressed audio performance data into compressed audio performance data.

Next, the CPU analyzes the acquired compressed audio performance data and produces meta data (step S112). Specifically, the CPU analyzes the compressed audio performance data to detect therefrom a main point, tempos, beat positions, fade positions, etc., and produces meta data having these parameters indicated therein. As a method for analyzing the compressed audio performance data, there can be mentioned, for example, a method in which the compressed audio performance data is signal-processed to detect a time-dependent change in sound volume or the periodicity of time-dependent change in sound volume, or in which such a detection is performed for signals having frequencies falling within a particular frequency range. In particular, by detecting the periodicity of sound volume change in a low-frequency range, bass drum beats or bass drum tempos can be detected. Alternatively, meta data can be produced or modified by the user, while listening to music sound reproduced from data obtained by expanding the compressed audio performance data.

Furthermore, the CPU causes the produced meta data to be stored in the external storage unit such as to correspond to the compressed audio performance data (step S113).

Referring to FIG. 5A again, in the process before the start of fitness exercise (3), the CPU 8 sets a stopgap measure (any of the connection methods) in accordance with user's operation or initialization (step S4).

FIGS. 12A to 12F are for explaining connection methods which can be selected by the music player MP. In FIGS. 12A to 12F, the above described six types of connection methods are shown, which are respectively given their names as "instantaneous changeover", "stopgap phrase insertion", "stopgap phrase insertion plus fade-out", "instantaneous changeover plus fade-out", "cross-fade", and "stopgap phrase insertion plus fade-in". As described above, the "instantaneous changeover" has been set in the initial setting, and therefore, the "instantaneous changeover" is set as the connection method unless the setting of the connection method is changed by the user. If the user changes the setting of the connection method, the "instantaneous changeover" is changed over to another connection method. To change the connection method, there may be mentioned, for example, a method in which, when the menu button 3*d* is operated by the user, a menu is displayed on the LCD 12*a*, and when an item used for changing the connection method is selected by the user from the menu, a list of the names of the six types of connection methods is displayed, thereby enabling the user to select the desired connection method. Of course, the method for changing the connection method is not limitative to this so long as the connection method can be changed.

Next, in accordance with user's operation or initialization, the CPU 8 sets the operation mode into either the walk mode or the jogging mode (step S5). As described previously, the walk mode is set in the initialization. Therefore, the operation mode is set into the walk mode, if the operation mode setting is not changed by the user. On the other hand, if the operation mode setting is changed by the user, the walk mode is changed to the jogging mode. The method for setting the operation mode may be the same as the above described method for changing the connection method setting.

Furthermore, in accordance with user's operation or initialization, the CPU 8 sets either the play list 13*a*1 for walk use or the play list 13*a*2 for jogging use into the play list (step S6). As the method for the play list setting, a method similar to the above described method for changing the connection method setting can be used. It should be noted that instead of positively setting the play list, it is possible to automatically set the play list corresponding to the operation mode when the operation mode is set.

When an instruction to start fitness exercise is given by the user by, for example, operating the menu button 3*d* (step S7), the CPU 8 causes the process to proceed to the processing at the start of fitness exercise (4). In this processing (4), the CPU 8 calculates an optimal heart rate curve based on the set operation mode (step S8). The optimal heart rate curve shown in FIG. 4 is calculated for a case where the jogging mode is set. The optimal heart rate curve represents a transition of heart rate from start to end of fitness exercise, which is optimum for the user performing fitness exercise in the set operation mode. The optimal heart rate curve varies between respective users, and therefore, must be calculated based on user information (such as age, exercise history, and physical condition). It should be noted that this invention is not characterized in a method for calculating the optimal heart rate curve, and the optimal heart rate curve can be calculated using any known method. Thus, an explanation of the calculation method is omitted herein.

Next, the CPU 8 initializes the target tempo to a minimum tempo value which varies according to the operation mode (step S9). The minimum tempo value is a minimum tempo value indicated in the personal information 13*b*1 or 13*b*2 of the personal information file 13*b*. In the example of FIG. 3, the initial value of the target tempo is set to 80 bpm when the walk mode is set. On the other hand, when the jogging mode is set, the initial value of target tempo is set to 140 bpm.

Next, the CPU 8 performs a music selection process to select music data having a tempo corresponding to the set target tempo (step S10).

Figure 8:
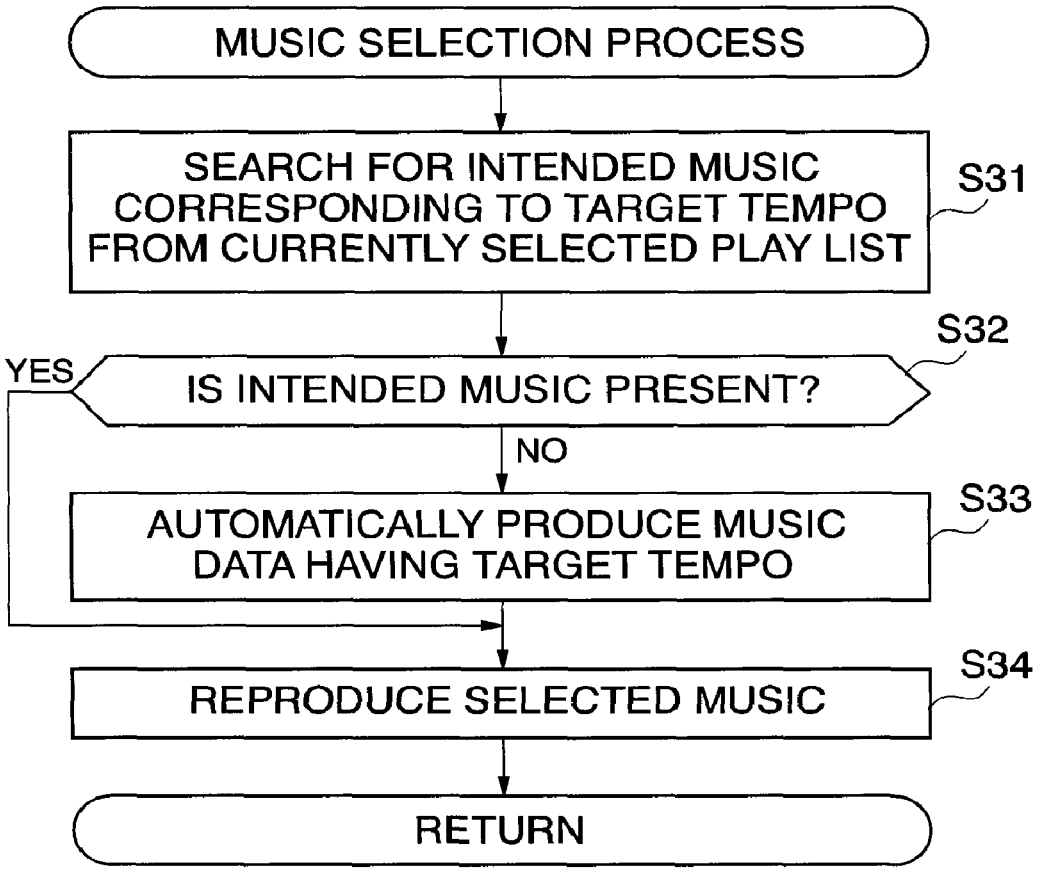
FIG. 8 is a flowchart showing in detail the procedure of a music selection process shown in FIG. 5B.

FIG. 8 shows in flowchart the detailed procedure of the music selection process.

In the music selection process, the CPU 8 searches for music having a tempo corresponding to the target tempo from the currently selected play list (step S31). Specifically, the CPU 8 accesses, one by one, pieces of meta data 13*cn* in music information file 13*c* which respectively correspond to pieces of music registered in the play list, and compares a main point value indicated in each of meta data 13*cn* with the target tempo value. If the main point value falls within a range in which the main point does not vary more than plus or minus 3% from the target tempo value, the music corresponding to the currently accessed meta data is determined as intended music. When a plurality of intended music are found, any of them is randomly selected and the selected music is finally determined as intended music, thereby preventing the same music from being always determined as the intended music.

As a result of the search in step S31, if it is determined that intended music is present, the CPU 8 gives an instruction to reproduce the music to the compressed audio decoder 16 (steps S32 and S34). On the other hand, if it is determined that intended music is not present, the CPU 8 automatically produces music data (MIDI data) having the target tempo (steps S32 and S33), and then instructs the MIDI tone generator circuit 15 to reproduce the produced MIDI data (step S34). It should be noted that this invention is not characterized by the way of automatically producing music data having a tempo corresponding to the target tempo, and therefore, any known method for producing such music data can be used.

When the music selection process is completed, the CPU 8 causes the process to proceed to the fitness process (5). The fitness process (5) is continued until an instruction to terminate the fitness exercise is given by the user or until an estimated completion time of fitness exercise (see FIG. 4) is reached.

Figure 9:
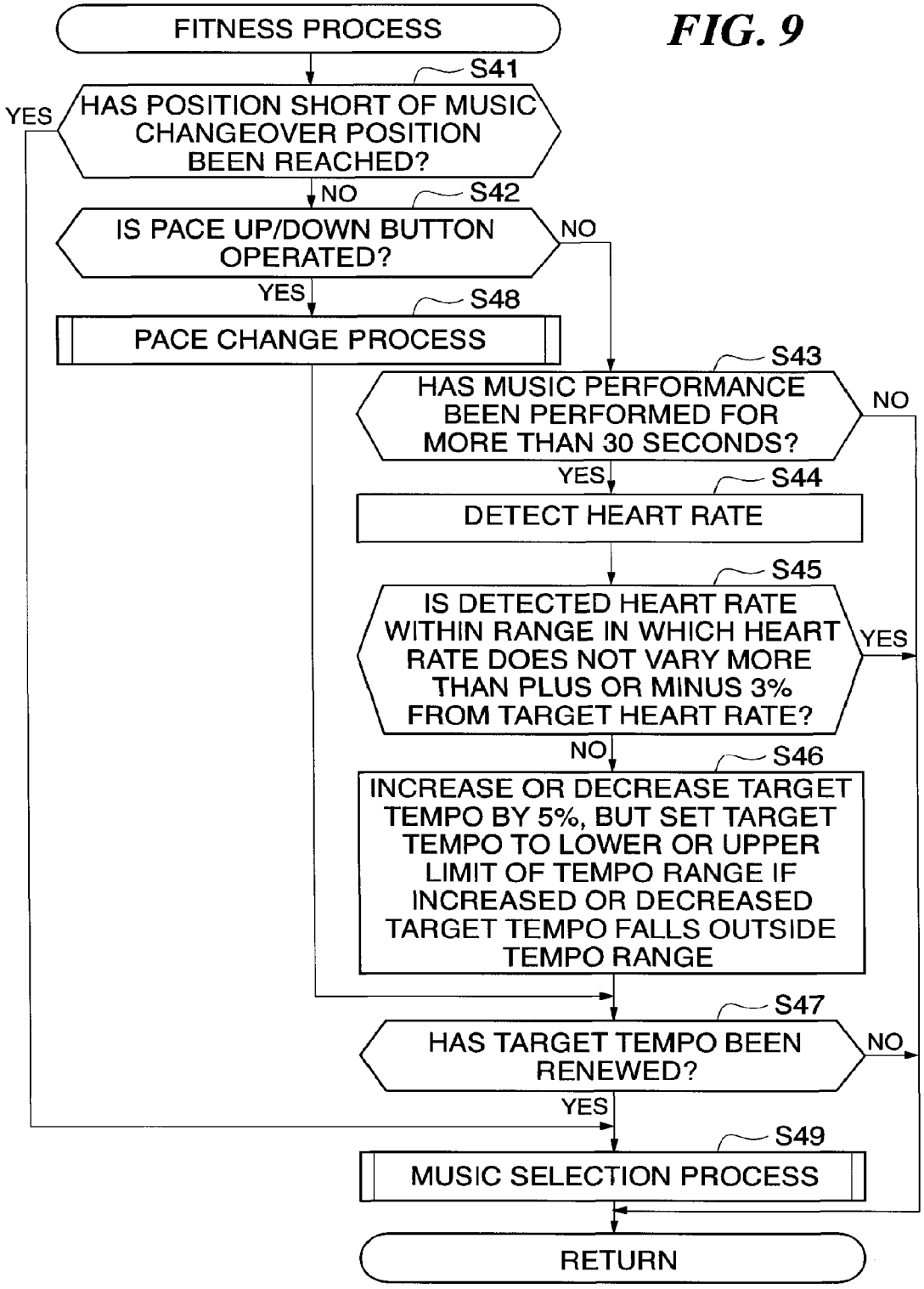
FIG. 9 is a flowchart showing in detail the procedure of a fitness process shown in FIG. 8.

FIG. 9 shows in flowchart the detailed procedure of the fitness process (5).

In the fitness process (5), the CPU 8 performs the following processes.

(21) A process for renewing the target tempo along the optimal heart rate curve (steps S44 to S46);

(22) A music selection process performed when the target tempo is renewed (steps S47 and S49);

(23) A pace change process performed when the pace up/down button 3*b* or 3*c* is operated (steps S42 and S48); and

(24) A music selection process performed when the music data performance has been reached to a position short of the changeover position by a predetermined distance (steps S41 and S49).

As described above, upon elapse of a predetermined time period (30 seconds in this embodiment) from the start of performance (playback) based on music data having a tempo corresponding to the target tempo (step S43), the CPU 8 causes the process to proceed to the target tempo renewal process (21). In this process (21), the CPU 8 detects user's pulse (heart rate) via the pulse detection circuit 5 (step S44). Next, the CPU 8 compares the detected heart rate with a target heart rate (a heart rate on the optimal heart rate curve at the time point of heart rate detection), and if the detected heart rate falls outside a range in which the heart rate does not vary more than plus or minus 3% from the target heart rate, the target tempo is increased or decreased by 5% (steps S45 and S46). Specifically, when the detected heart rate is more than 3% higher than the target heart rate, the current fitness exercise is too hard for the user, and the target tempo is decreased by 5% to decrease the load of the user. On the other hand, if the detected heart rate is more than 3% lower than the target heart rate, the current fitness exercise is too light for the user and the target tempo is increased by 5% to increase the load of the user. If, however, the target tempo falls outside a tempo range determined by the selected personal information (either the personal information 13*b*1 or 13*b*2) due to the increase or decrease in the target tempo, the target tempo is set to the lower or upper limit of the tempo range (the minimum or maximum tempo value). When the detected heart rate is within the range in which the hear rate does not vary more than plus or minus 3% from target heart rate (step S45), the target tempo is kept unchanged.

When the target tempo has been renewed by the target tempo renewal process (21), the CPU 8 causes the process to proceed to the music selection process (22) (steps S47 and S49). In this process (22), the CPU 8 performs the music selection process which is basically the same as the process shown in FIG. 8 but partly changed therefrom (in respect of the processing in the step S49), to thereby select music data having a tempo corresponding to the target tempo. In the following, the way of how the music data changeover position upon changeover from music data being currently reproduced to selected music data is determined will be first described, and then the way of how part of the music selection process is changed will be described.

Figure 11A:
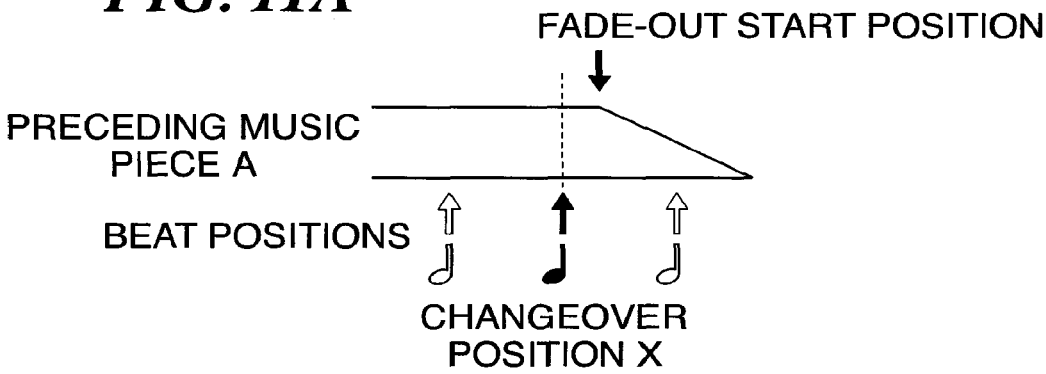
Figure 11B:
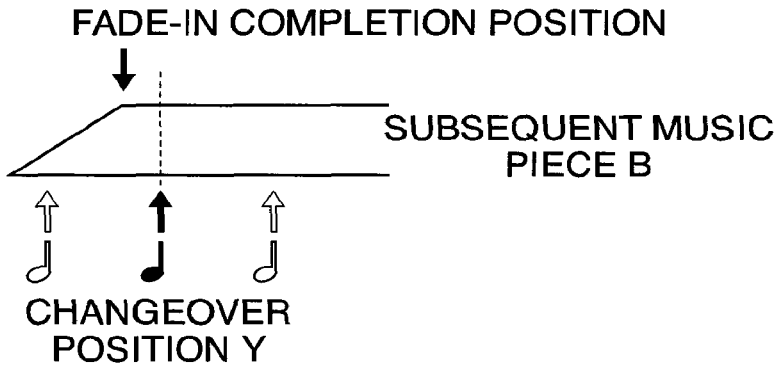
Figure 11C:
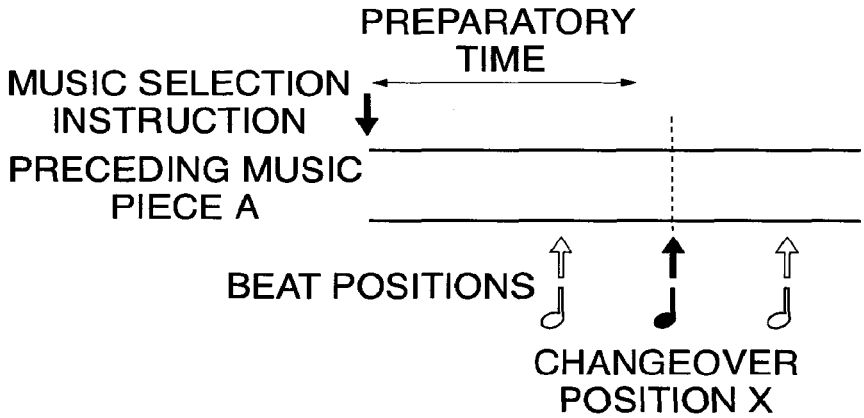

FIGS. 11A to 11C are for explaining the way of how the music data changeover position is determined. Specifically, FIGS. 11A and 11B show a case where the changeover to the next music data is performed when music data is reproduced up to near the end of the music data, whereas FIG. 11C shows a case where the changeover to the next music data is performed in the midst of the reproduction of music data. The case where the changeover of music data is performed in the music selection process (22) corresponds to the case shown in FIG. 11C, whereas the case shown in FIGS. 11A and 11B corresponds to the case where the music data changeover is performed in the music selection process (24). These two cases will collectively be described below since the changeover in both the cases is carried out based on beat position.

FIG. 11A shows a case where the preceding music piece A is made to fade out when the music is reproduced up to near the end of the music (as shown in FIGS. 12D and 12E), whereas FIG. 11B shows a case where the subsequent music piece B is made to fade in at that time (as shown in FIG. 12E).

In the case that the preceding music piece A is made to fade out, but the subsequent music piece B is not made to fade in upon changeover of music (as shown in FIG. 12D), the CPU 8 acquires a beat position X immediately short of a fade-out start position, and starts the reproduction of the subsequent music piece B at the same time when the music is reproduced to the beat position X. It should be noted that the reproduction start position for the subsequent music piece B is made to match a beat position appearing for the first time in music data. The beat positions in the preceding music piece A and the subsequent music piece B are respectively specified in meta data concerned (see FIG. 3), which makes it easy to acquire the beat position X and start the music reproduction at a beat position Y.

In the case that upon changeover of music, the preceding music piece A is changed over to the subsequent music piece B while being cross-faded (as shown in FIG. 12E), the beat position X immediately short of the fade-out start position is acquired, and the beat position Y immediately after a position at which the fade-in is completed is also acquired. Then, the start of reproduction of the subsequent music piece B is moved up to make the beat positions X and Y to match each other. By referring to the beat position in the meta data corresponding to the preceding music piece A and the fade position in the meta data corresponding to the subsequent music piece B, the subsequent music piece B can easily be reproduced such that the beat positions X and Y are made to match each other.

FIG. 11C shows a case that the changeover to the next music data is carried out in the midst of music reproduction (as shown in FIG. 12A). In that case, if the changeover to the subsequent music piece B is performed immediately after a music selection instruction is given, there occurs a deviation between the beat positions in the preceding music piece A and the subsequent music piece B. To obviate this, the changeover to the subsequent music piece B is carried out after the music is reproduced up to the beat position in the preceding music piece A. Upon changeover to the reproduction of the next music piece, a predetermined preparatory time (for example, one second) is required. Therefore, the beat position appearing for the first time after the elapse of the preparatory time from when a music selection instruction is given is acquired as the changeover position for the preceding music piece A, i.e., the beat position X, and the reproduction of the subsequent music piece B is started at the same time when the music is reproduced up to the beat position X.

In this embodiment, the preceding music piece A is changed over to the subsequent music piece B based on beat positions X, Y in the preceding music piece A and the subsequent music piece B, using the positions X, Y as changeover position. However, it is not inevitably necessary to use the beat positions X, Y as changeover position since the changeover from the preceding music piece A to the subsequent music piece B can be made in any state, if the beats of the music pieces match each other. In other words, the changeover position may be set to a position shifted from the beat positions X, Y by predetermined timing (for example, a position shifted by half a beat), with the beats of the music pieces made to match each other. Specifically, in the example shown in FIG. 11A, the changeover position X may be set at a position a half-beat short of the beat position located immediately before the fade-out start position, and the changeover position Y may be set at a position a half-beat after the beat position located at immediately after the fade-in completion position.

In the above, how the music data changeover position can be determined has been described by taking as examples the cases of FIGS. 12A, 12D, and 12E. In addition to the connection methods shown in FIGS. 12A, 12D, and 12E, connection methods shown in FIGS. 12B, 12C, and 12F are also provided in this embodiment, as described below.

FIGS. 12B, 12C, and 12F show examples in which a stopgap phrase is inserted between the preceding music piece A and the subsequent music piece B.

FIG. 12B shows an example where reproduction of the preceding music piece A is instantaneously changed over to reproduction of a stopgap phrase, without the preceding music piece A being faded out, and the reproduction of the stopgap phrase is instantaneously changed over to reproduction of the subsequent music piece B, without the subsequent music piece B being faded in. In that case, the beat position X in the preceding music piece A and the beat position Y in the subsequent music piece B are acquired as described above, and the reproduction of the stopgap phrase is started at the same time when the music is reproduced up to the beat position X, and the reproduction of the subsequent music piece B is started from the beat position Y at the same time when the music is reproduced up to the end of the stopgap phrase.

FIG. 12C shows an example where the stopgap phrase is reproduced while the preceding music piece A is being faded out, and the reproduction of the stopgap phrase is instantaneously changed over to reproduction of the subsequent music piece B. In that case, as with the case shown in FIG. 12D, the reproduction of the stopgap phrase is started at the same time when the music is reproduced up to the beat position X in the preceding music piece A, and the fade-out of the preceding music piece A is started when the preceding music piece A is reproduced to the fade-out start position while the stopgap phrase is reproduced. In the fade-out of the preceding music piece A, the sound volume of the preceding music piece A is decreased at such a rate that the sound of the preceding music piece A is muted before completion of the reproduction of the stopgap phrase. Then, at the same time when the music is reproduced up to the end of the stopgap phrase, the reproduction of the subsequent music piece B is started at the beat position Y.

FIG. 12F shows an example where reproduction of the preceding music piece A is instantaneously changed over to reproduction of the stopgap phrase, which is then changed over to reproduction of the subsequent music piece B, with the subsequent music piece B being faded in while the stopgap phrase is reproduced. In that case, the reproduction of the stopgap phrase is started at the same time when the music is reproduced up to the beat position X in the preceding music piece A. During the reproduction of the stopgap phrase, the fade-in of the subsequent music piece B is started at such a position and with such a rate as to cause the subsequent music piece B to be reproduced up to the beat position Y at completion of the reproduction of the stopgap phrase.

In this embodiment, compressed audio performance data is used for each of the preceding music piece A and the subsequent music piece B, if such data is registered in the play list concerned. Since almost all the compressed audio performance data for use by the user for immediate needs are registered in the play list, compressed audio performance data corresponding to the preceding music piece A and the subsequent music piece B can be selected in most cases. If compressed audio performance data are selected for both the preceding music piece A and subsequent music piece B, two compressed audio decoders 16 are required to concurrently reproduce these compressed audio performance data as shown in FIGS. 12D and 12E. In this embodiment, the music player MP can have two compressed audio decoders 16 to concurrently reproduce two pieces of compressed audio performance data. In practice, however, it is preferable that the music player MP should have a single compressed audio decoder 16 from the viewpoint of reducing fabrication costs of the player. In the case of the music player provided with a single compressed audio decoder 16, it is impossible to concurrently reproduce two pieces of compressed audio performance data. To obviate this, the stopgap phrase may be generated in the form of MIDI data, which can be reproduced by the MIDI tone generator circuit 15. In that case, the preceding music piece A can be connected to the subsequent music piece B, while the preceding music piece is being faded out, as shown in FIG. 12C. Also, the preceding music piece A can be connected to the subsequent music piece B, while the subsequent music piece B is being faded in, as shown in FIG. 12F. As described above, when a music piece not registered in the play list is selected, the selected music piece is generated in the form of MIDI data and is reproduced. Thus, the MIDI tone generator circuit 15 must be provided although the elimination thereof is preferable for cost reduction. In the case that both the preceding music piece A and the subsequent music piece B are MIDI data and if the stopgap phrase is also MIDI data, if there are provided a plurality of sounding channels in the MIDI tone generator circuit 15, the same number of music pieces as the number of sounding channels can simultaneously be reproduced (provided that each music piece is reproduced by a single tone). In that case, the preceding music piece A, the subsequent music piece B, and the stopgap phrase can be reproduced without difficulty, even if they are superimposed one another.

Next, a method for generating the stopgap phrase will be described.

In this embodiment, the stopgap phrase is generated in the form of MIDI data whose tempo can freely be changed as compared to audio data. In a case that there is a large difference in tempo between the preceding music piece A and the subsequent music piece B, even if the generated stopgap phrase is constant in tempo (which is the case where the stopgap phrase is selected from among a plurality of stopgap phrases stored in the flash memory 13 and each having a constant tempo), the CPU 8 is able to change the tempo of the stopgap phrase as desired. As a result, there can be inserted the stopgap phrase whose tempo gradually changes from the tempo of the preceding music piece A to the tempo of the subsequent music piece B. At this time, by generating the stopgap phrase only comprised of rhythm tone color (for example, drum tone color), the preceding music piece A can relatively smoothly be connected to the subsequent music piece B without being affected by a tune of the preceding music piece A and a tune of the subsequent music piece B whatever their tunes. If there is a difference in tempo between the preceding music piece A and the subsequent music piece B, some user feels comfortable when the tempo immediately changes from the tempo of the preceding music piece A to the tempo of the subsequent music piece B rather than when the tempo gradually changes to the tempo of the subsequent music piece B. For such a user, there can be generated the stopgap phrase having a tempo that is the same as the tempo of the subsequent music piece and that does not change with progression of music.

In this embodiment, the case where the tempo of each of the preceding music piece A and the subsequent music piece B is acquired as a musical tone characteristic thereof has been described, and the stopgap phrase of what tempo should be generated based on the acquired tempo has been explained. However, the musical tone characteristic to be acquired is not limited to the tempo, but may be any other characteristic. Since the musical tone characteristic is indicated in the meta data 13*cn* and therefore can easily be acquired. Specifically, the preceding music piece A and the subsequent music piece B may be subjected to frequency analysis, thereby determining in advance a time-dependent variation in power spectrum thereof as a value of EXCITE/CALM which is one of atmosphere information. Then there can be generated, as stopgap phrase, a MIDI phrase in which the number of musical tones to be sounded gradually changes such as to realize a gradual change from the preceding music piece A to the subsequent music piece B, or a phrase having the number of musical tones to be sounded which corresponds to that of either the preceding music piece A or the subsequent music piece B. Alternatively, there can be generated a phrase whose sound volume gradually changes from the preceding music piece A to the subsequent music piece B or whose sound volume matches that of either the preceding music piece A or the subsequent music piece B.

As described above, in this embodiment, the stopgap phrase is generated in the form of MIDI data based on the musical tone characteristic of at least one of the preceding music piece A and the subsequent music piece B, but this is not limitative. A plurality of compressed audio performance data each being selectable as stopgap phrase can be stored in the flash memory 13, and from among these, the stopgap phrase suited to the musical tone characteristic can be selected. In that case, since the flash memory 13 is small in storage capacity and a large number of stopgap phrases cannot be stored therein, a limited number of stopgap phrases which are neutral and not affected by tune and which are suited to any combination of preceding music piece A and subsequent music piece B whatever their musical tone characteristics should be stored in the flash memory 13.

If a music piece which is a classic in genre, a therapeutic music in tune, and is 80 bpm in tempo is selected as the preceding music piece A and another music piece which is hard rock in genre, a hot number in tune, and 180 bpm in tempo is selected as the subsequent music piece B, there may be selected the stop phrase in which bass drum is gradually faded in while an ambient phrase without beats is reproduced, and finally ambient tones are faded out and only bass drum tones are sounded in a tempo of the subsequent music piece B. To this end, such a stopgap phrase is stored beforehand in the flash memory 13. The "fade-in" and the "fade-out" in the stopgap phrase do not relate to the "fade-out" in the preceding music piece A and the "fade-in" in the subsequent music piece B. The musical tone characteristic (genre, tune, tempo, and the like) of each of the preceding music piece A and the subsequent music piece B is indicated in the meta data 13*cn* concerned as described above, and hence can be acquired with ease.

On the other hand, if a music piece which is a pops in genre, bright (C major) in tune, and 120 bpm in tempo is selected as the preceding music piece A and another music piece which is a R&B in genre, sad (A minor) in tune, and 90 bpm in tempo is selected as the subsequent music piece B, there may be selected the stopgap phrase in which a C major chord phrase is smoothly modulated to an A minor chord phrase. To this end, such a stopgap phrase is stored beforehand in the flash memory 13.

It should be noted that the above described stopgap phrases are shown by way of example. The stopgap phrase of the above described tune is not necessarily selected, even if the musical tone characteristic of each of the preceding music piece A and the subsequent music piece B is determined. To select or generate the stopgap phrase, the musical tone characteristic of at least one of the preceding music piece A and the subsequent music piece B is acquired, and with reference to the acquired musical tone characteristic, the tune of the stopgap phrase is determined. One of features of this invention resides in this point.

Next, an explanation will be given of how a part of the music selection processing shown in FIG. 8 is changed.

As described above, in the music selection processing of FIG. 8, if the intended music is found as a result of search in step S31, the CPU 8 gives an instruction to reproduce the searched music to the compressed audio decoder 16 in step S34. On the other hand, if no intended music is found, the CPU 8 automatically generates music data (MIDI data) with a target tempo, and instructs the MIDI tone generator circuit 15 to reproduce the generated MIDI data. In the processing in the step S34, the preceding music piece A and the subsequent music piece B can be reproduced, even if either one of these music pieces is compressed audio performance data or MIDI data. Since the way of how music pieces are changed over and reproduced is to be described here, it is assumed by way of example that both the preceding music piece A and the subsequent music piece B are compressed audio performance data.

Since the connection method is already set in step S4 in FIG. 5A, the CPU 8 causes the preceding music piece A to be changed over to the subsequent music piece B in accordance with the set connection method. For example, if the "instantaneous changeover" (see FIG. 12A) is set as the connection method, in response to a music selection instruction, the CPU 8 acquires the beat position X that will appear for the first time in the preceding music piece A after elapse of the preparatory time from meta data corresponding to the preceding music piece A, and acquires the beat position Y representing a reproduction start position for the subsequent music piece B from meta data corresponding to the subsequent music piece B, as previously explained with reference to FIG. 11C. Then, at the same time when the reproduction is performed up to the beat position X, the CPU 8 gives an instruction to reproduce the subsequent music piece B to the compressed audio decoder 16. On the other hand, if the "stopgap phrase insertion" (see FIG. 12B) is set as the connection method, in response to a music selection instruction, the CPU 8 acquires the beat positions X and Y in the same manner as in the case of the "instantaneous changeover" being set. Then, at the same time when the reproduction is performed up to the beat position X, the CPU 8 gives an instruction to stop the reproduction of the preceding music piece A to the compressed audio decoder 16, and gives an instruction to start the reproduction of the stopgap phrase to the MIDI tone generator circuit 15. At the same time when the reproduction is performed to the end of the stopgap phrase, the CPU 8 gives an instruction to reproduce the subsequent music piece B to the compressed audio decoder 16. An explanation on the reproduction process for a case where another connection method is set is omitted here, since such a process can be carried out in the light of the above described explanation on the reproduction process for the case where the "instantaneous changeover" or the "stopgap phrase insertion" is set.

Referring to FIG. 9 again, when the user operates the pace up/down button 3*b* or 3*c* during the fitness process, the CPU 8 causes the process to proceed to the pace change process (23).

Figure 10:
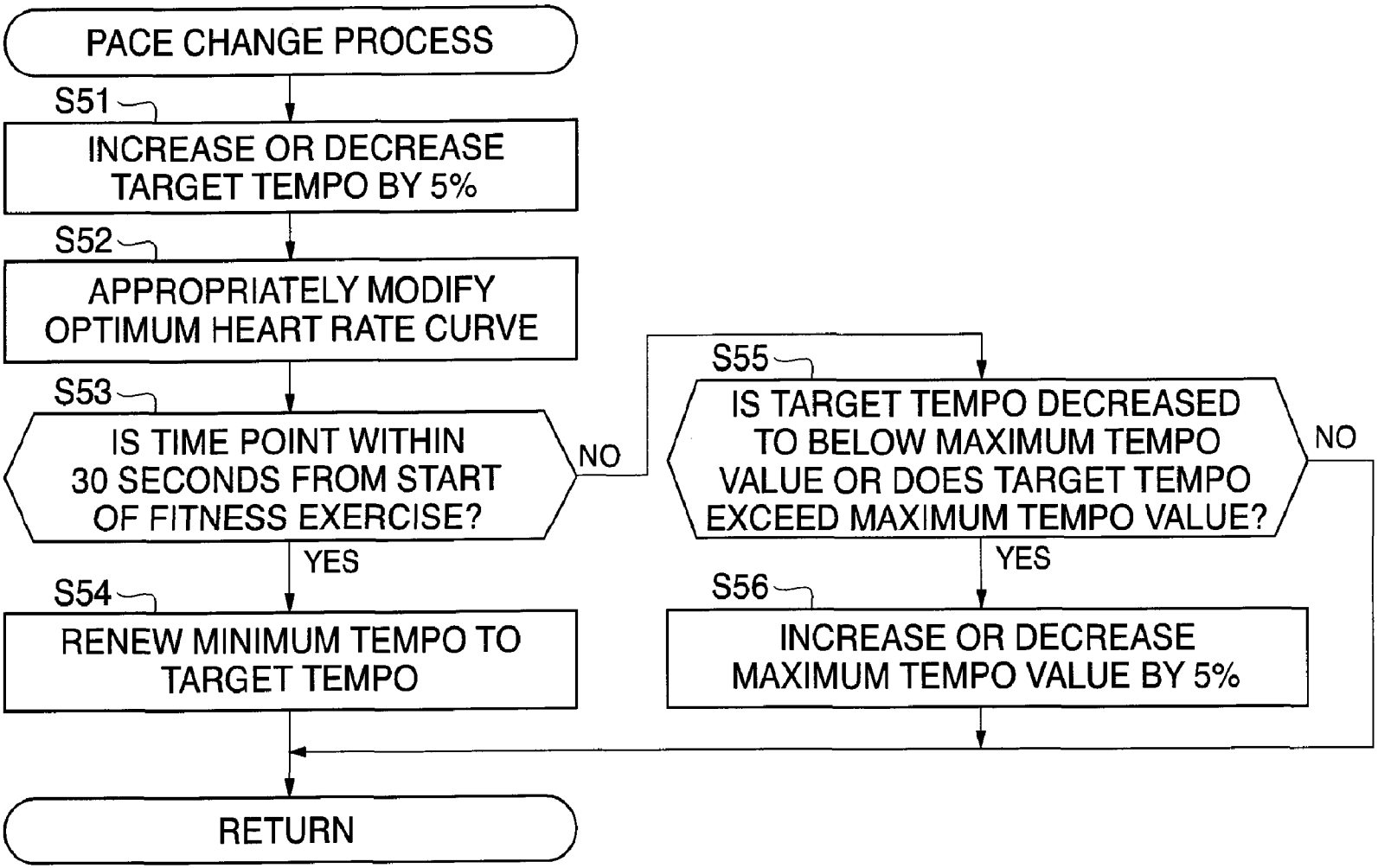
FIG. 10 is a flowchart showing in detail the procedure of a pace change process shown in FIG. 9.

FIG. 10 shows in flowchart the detailed procedure of the pace change process (23).

In the pace change process (23), when the pace-up button 3*b* is operated, the CPU 8 increases the target tempo by 5%. On the other hand, when the pace-down button 3*c* is operated, the target tempo is decreased by 5% (step S51).

Next, the CPU 8 appropriately modifies the shape of the optimal heart rate curve in accordance with the increase/decrease in target tempo (step S52). The words "appropriately modify" implies that the shape of the optimal heart rate curve may not be modified. In such a case, even if the user operates the pace up/down button 3*b* or 3*c* so as to increase or decrease the target tempo and musical performance is performed based on music data having a tempo corresponding to the increased or decreased target tempo, the target heart rate per se remains the same as a value on the original optimal heart rate curve. As a result, the target tempo is gradually made close to the target tempo determined based on the original optimal heart rate curve, i.e., the target tempo for the case that the pace up/down button 3*b* or 3*c* is not operated, whereas a state is continued where the detected heart rate varies more than plus or minus 3% from the target heart rate. In other words, even if the pace up/down button 3*b* or 3*c* is operated and the target tempo is renewed, the renewed target tempo is only temporarily maintained. When the pace up/down button 3*b* or 3*c* is operated and the target tempo is renewed, therefore, it is preferable that the shape of the optimal heart rate curve should also be modified accordingly. The degree of modification of the curve shape may be a 5% increase or decrease similarly to the degree of modification of the target tempo, but may be greater or smaller than 5%. In addition, the degree of modification can be varied according to a time period for which the fitness exercise has been performed.

Next, the CPU 8 determines whether or not a time point at which an instruction to increase or decrease the target tempo has been given by the pace up/down button 3*b* or 3*c* is within 30 seconds from the start of the fitness exercise. If so, the minimum tempo value in the currently set operation mode is renewed to the increased or decreased target tempo value (steps S53 and S54). Specifically, in the case that the jogging mode is currently set and the initial value of target tempo has been set at 140 bpm, when the pace-down button 3*c* is operated by the user within 30 seconds from the start of fitness exercise, the target tempo is changed to 133 bpm (5% smaller than 140 bpm), and the minimum tempo value of the personal information 13*b*2 is made equal to the changed target tempo of 133 bpm. As a result, the minimum tempo value of the personal information 13*b*2 is renewed from 140 bpm to 133 bpm. It should be noted that the minimum tempo value of the personal information 13*b*2 is not immediately renewed by the processing in step S54 but temporarily renewed. The renewal is fixed upon receipt of user's approval in the processing in step S14 described below.

When the pace-down button 3*c* is operated by the user and the target tempo is decreased to below the maximum tempo value after elapse of more than 30 seconds from the start of fitness exercise or when the pace-up button 3*b* is operated and the target tempo exceeds the maximum tempo value, the maximum tempo value in the operation mode currently set is renewed by the CPU 8 to the increased or decreased target tempo value (steps S55 and S56). More specifically, in the state that the jogging mode has been set and the target tempo has been set to 190 bpm, when the pace-down button 3*c* is operated by the user, the target tempo is changed to 181 bpm (5% smaller than 190 bpm), and the maximum tempo vale of the personal information 13*b*2 is made equal to the changed target tempo of 181 bpm. As a result, the maximum tempo value of the personal information 13*b*2 is renewed from 190 bpm to 181 bpm. It should be noted that the maximum tempo value of the personal information 13*b*2 is not immediately renewed by the processing in step S56 but temporarily renewed. The renewal is fixed upon receipt of user's approval in the processing in S14.

When the target tempo has been changed by the pace change process (23) as described above, the CPU 8 subsequently performs the music selection process in step S49.

When the selected music data is performed up to a position short of the music changeover position by a predetermined distance (step S41), the CPU 8 causes the process to the music selection process (24). In the process (24), the CPU 8 selects music data having a tempo corresponding to a target tempo by performing a music selection process in step S49, in which the music selection process in FIG. 8 is partly changed (step S49). It should be noted that in the case of the preceding music piece A of a type whose reproduction is completed while being faded out, when the preceding music piece A is changed over to the subsequent music piece B after the preceding music piece A has been faded out, the rhythm of user's exercise or dance is disturbed even if beats are matched between the music pieces. To obviate this, in the present invention, the reproduction of the subsequent music piece B or the stopgap phrase is started at a beat position appearing before the start of fade-out of the preceding music piece A. To this end, if the music currently reproduced is of a type completed while being faded out, whether or not a beat position immediately short of the fade-out position by a predetermined distance is reached is determined in the determination process of the step S41.

Referring to FIG. 5B again, when the fitness process (5) is finished (step S12), the CPU 8 causes the process to proceed to the process upon completion of fitness exercise (6). In this process (6), when the maximum or minimum tempo value indicated in the personal information has been changed, the CPU 8 writes the content of change into the corresponding personal information in the personal information file 13*b* upon receipt of user's approval (steps S13 and S14).

As described above, in this embodiment, the reproduction of the preceding music piece A can be changed over to the reproduction of the subsequent piece B, with silent parts and fade-in/out parts of the preceding music piece A and the subsequent music piece B removed and the beat positions in the preceding music piece A and the subsequent music piece B made to match each other. As a result, music pieces can be reproduced while making changeover therebetween without disturbing the rhythm of exercise, dance, or the like performed by the user to the rhythm of music.

In addition, the musical tone characteristic of each of the preceding music piece A and the subsequent music piece B is acquired, and based on the acquired musical tone characteristic, the stopgap phase for use in connecting the preceding music piece A and the subsequent music piece B is generated. As a result, the preceding music piece A can smoothly be connected to the subsequent music piece B, whereby the rhythm of user's exercise or dance can be prevented from being disturbed. Furthermore, since the musical tone characteristic analyzed beforehand by another apparatus (the PC 100 in this embodiment) and written into meta data concerned is read out and acquired by the CPU 8, the CPU 8 may not have high calculation ability capable of analyzing the musical tone characteristic of music data, whereby fabrication costs can be reduced.

In this embodiment, the music selection process is performed each time the target tempo is renewed by the pace changing operation. However, since a frequent change of music is unnatural and impractical, it is preferable that the change of music should be prohibited until 30 seconds have elapsed from the preceding change of music.

It is to be understood that the present invention may also be accomplished by supplying a system or an apparatus with a storage medium in which a program code of software, which realizes the functions of the above described embodiment is stored, and causing a computer (or CPU or MPU) of the system or apparatus to readout and execute the program code stored in the storage medium.

In this case, the program code itself read from the storage medium realizes the novel functions of the present invention, and hence the program code and a storage medium on which the program code is stored constitute the present invention.

Examples of the storage medium for supplying the program code include a flexible disk, a hard disk, a magneto-optical disk, an optical disk such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program code may be downloaded from a server computer via a communication network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code readout from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

This application is based on, and claims priority to, Japanese Patent Application Nos. 2007-085509 and 2007-085510, both filed on 28 Mar. 2007. The disclosures of the priority applications, in their entirety, including the drawings, claims, and the specification thereof, are incorporated herein by reference

What is claimed is:

1. A performance apparatus comprising:

a storage unit adapted to store a plurality of performance data;

a selection unit adapted to select any of the plurality of performance data stored in said storage unit;

a first reproduction unit adapted to reproduce performance data selected by said selection unit, as non-MIDI audio-data;

a control unit adapted to control said first reproduction unit such that preceding performance data being reproduced by said first reproduction unit is changed over to subsequent performance data selected by said selection unit and performance data reproduction is continuously carried out;

a musical tone characteristic acquisition unit adapted to acquire a musical tone characteristic of at least one of the preceding performance data and the subsequent performance data;

a generation unit adapted, based on the musical tone characteristic acquired by said musical tone characteristic acquisition unit, to generate stopgap performance data for connecting between the preceding performance data and the subsequent performance data; and a second reproduction unit adapted to reproduce the stopgap performance data generated by said generation unit, as MIDI data, wherein said control unit is adapted to control said second reproduction unit such that the stopgap performance data of MIDI data is inserted between the preceding performance data of non-MIDI audio-data and the subsequent performance data of non-MIDI audio-data and is reproduced.

2. The performance apparatus according to claim 1, wherein said musical tone characteristic acquisition unit is adapted to acquire musical tone characteristics of both the preceding performance data of non-MIDI audio-data and the subsequent performance data of non-MIDI audio-data, and said generation unit is adapted to generate stopgap performance data that varies from the musical tone characteristic of the preceding performance data of non-MIDI audio-data to the musical tone characteristic of the subsequent performance data of non-MIDI audio-data with elapse of time.

3. The performance apparatus according to claim 1, further including:

a stopgap performance data storage unit adapted to store a plurality of pieces of the stopgap performance data of MIDI data, wherein said generation unit is adapted to select the stopgap performance data of MIDI data from among the plurality of pieces of the stopgap performance data of MIDI data stored in said stopgap performance data storage unit in accordance with the musical tone characteristic acquired by said musical tone characteristic acquisition unit.

4. The performance apparatus according to claim 1, further including:

a transmission/reception unit adapted to be connected to an external unit for data transmission and data reception to and from the external unit; and a data acquisition unit adapted to acquire, from the external unit via said transmission/reception unit, pieces of performance data and pieces of musical tone characteristic data each indicating a musical tone characteristic of a corresponding one of the performance data, wherein said storage unit is adapted to store the performance data acquired by said acquisition unit and also store the musical tone characteristic data corresponding to the performance data, and said musical tone characteristic acquisition unit is adapted to acquire the musical tone characteristic of at least one of the preceding performance data of non-MIDI audio-data and the subsequent performance data of non-MIDI audio-data from the musical tone characteristic data stored in said storage unit.

5. A non-transitory computer-readable storage medium storing a program for causing a computer to execute a method for controlling a performance apparatus including a storage unit storing a plurality of performance data, the method comprising:

a selection step of selecting any of the plurality of performance data stored in the storage unit;

a first reproduction step of reproducing performance data selected in said selection step, as non-MIDI audio-data;

a control step of controlling said first reproduction step such that preceding performance data being reproduced in said first reproduction step is changed over to subsequent performance data selected in said selection step and performance data reproduction is continuously carried out;

a musical tone characteristic acquisition step of acquiring a musical tone characteristic of at least one of the preceding performance data and the subsequent performance data;

a generation step of generating, based on the musical tone characteristic acquired in said musical tone characteristic acquisition step, stopgap performance data for use in connecting between the preceding performance data and the subsequent performance data; and a second reproduction step of reproducing the stopgap performance data generated in said generation step, as MIDI data, wherein said control step controls said second reproduction step such that the stopgap performance data of MIDI data is inserted between the preceding performance data of non-MIDI audio-data and the subsequent performance data of non-MIDI audio-data and is reproduced.

6. The performance apparatus according to claim 1, wherein each of the plurality of performance data stored in said storage unit includes beat positions, said musical tone characteristic acquisition unit comprises a beat position acquisition unit adapted to acquire a first beat position in the preceding performance data of non-MIDI audio-data and acquire a last beat position in the subsequent performance data of non-MIDI audio-data, and said control unit is adapted to control said second reproduction unit such that reproduction of the stopgap performance data of MIDI data is started at the same time when the preceding performance data of non-MIDI audio-data is reproduced up to the last beat position, and reproduction of the subsequent performance data of non-MIDI audio-data is started from the first beat position at the same time when the subsequent performance data of non-MIDI audio-data is reproduced up to the end of the stopgap.

7. The performance apparatus according to claim 6, wherein said control unit is adapted to control said second reproduction unit such that the stopgap performance data of MIDI data is inserted between the preceding performance data of non-MIDI audio-data and the subsequent performance data of non-MIDI audio-data and is reproduced while the preceding performance data of non-MIDI audio-data is being faded out, the subsequent performance data of non-MIDI audio-data is being faded in, or the preceding performance data of non-MIDI audio-data is being faded out and the subsequent performance data of non-MIDI audio-data is being faded in.

8. The performance apparatus according to claim 1, wherein each of the plurality of performance data stored in said storage unit includes beat positions, said musical tone characteristic acquisition unit comprises a beat position acquisition unit adapted to acquire a beat position "X" in the preceding performance data of non-MIDI audio-data and acquire a beat position "Y" in the subsequent performance data of non-MIDI audio-data, and said control unit is adapted to control said second reproduction unit such that reproduction of the stopgap performance data of MIDI data is started at the same time when the preceding performance data of non-MIDI audio-data is reproduced at the beat position "X", and reproduction of the stopgap performance data of MIDI data is completed at the same time when the subsequent performance data of non-MIDI audio-data is reproduced at the beat position "Y".

9. The performance apparatus according to claim 8, wherein said control unit is adapted to control said second reproduction unit such that the stopgap performance data of MIDI data is inserted between the preceding performance data of non-MIDI audio-data and the subsequent performance data of non-MIDI audio-data and is reproduced while the preceding performance data of non-MIDI audio-data is being faded out, the subsequent performance data of non-MIDI audio-data is being faded in, or the preceding performance data of non-MIDI audio-data is being faded out and the subsequent performance data of non-MIDI audio-data is being faded in.

* * * * *